US010472027B1

(12) United States Patent
Croft

(10) Patent No.: US 10,472,027 B1
(45) Date of Patent: Nov. 12, 2019

(54) WATER RIDING APPARATUS

(71) Applicant: David Thomas Croft, Plantation, FL (US)

(72) Inventor: David Thomas Croft, Plantation, FL (US)

( * ) Notice: Subject to any disclaimer, the term of this patent is extended or adjusted under 35 U.S.C. 154(b) by 16 days.

(21) Appl. No.: 15/635,871

(22) Filed: Jun. 28, 2017

Related U.S. Application Data

(60) Provisional application No. 62/356,306, filed on Jun. 29, 2016.

(51) Int. Cl.
*B63B 35/83* (2006.01)
*B63B 35/81* (2006.01)
*B63H 16/04* (2006.01)

(52) U.S. Cl.
CPC ..... *B63B 35/83* (2013.01); *B63B 35/81* (2013.01); *B63H 16/04* (2013.01); *B63B 2035/813* (2013.01)

(58) Field of Classification Search
CPC ... B63B 35/81; B63B 2035/813; B63B 35/83; B63H 16/04
USPC ..... 441/76–78
See application file for complete search history.

(56) References Cited

U.S. PATENT DOCUMENTS 2,153,939 A * 4/1939 Schaupp ..... B63B 35/83 441/77
3,084,356 A * 4/1963 Wheat ..... B63B 35/83 237/12.3 A
3,121,892 A * 2/1964 Plumlee ..... B63B 35/83 441/77
3,758,898 A * 9/1973 Dougherty ..... B63B 35/83 441/77
3,835,494 A * 9/1974 Dougherty ..... B63B 35/83 441/77
3,936,897 A * 2/1976 Schaumann ..... B63B 35/83 441/77
4,129,912 A * 12/1978 Robinson ..... B63B 1/12 280/818
7,121,910 B2 * 10/2006 Rosen ..... B63B 35/83 441/76
7,354,326 B2 * 4/2008 Lukens ..... B63B 1/125 114/123
7,361,071 B1 * 4/2008 Lauren ..... B63B 35/83 441/76

* cited by examiner

*Primary Examiner* — Ajay Vasudeva
(74) *Attorney, Agent, or Firm* — John Rizvi; John Rizvi, P.A.—The Patent Professor ®

(57) ABSTRACT

A water riding apparatus is provided for moving along the surface of water in cross-country skier type fashion. The water riding apparatus includes a first pontoon having an elongate hull and a second pontoon having an elongate hull. The first and second elongate hulls are connected together for relative parallel longitudinal motion by a gliding mechanism affixed to inner sides of the first and second elongate hollow hulls. The first and second elongate hulls include foot well openings allowing the user to stand on the bottoms of the hulls at a location below the water line of the hulls. The water riding apparatus further includes a personal stabilizer system for supporting a user in a standing position. The first and second elongate hulls can be locked in a parallel, transversely aligned relationship to allow alternative use of the water riding apparatus in a sitting, kayak-type fashion.

14 Claims, 21 Drawing Sheets

WATER RIDING APPARATUS

CROSS-REFERENCE TO RELATED APPLICATIONS

This application claims the benefit of U.S. Provisional Patent Application Ser. No. 62/356,306, filed on Jun. 29, 2016, which is incorporated herein in its entirety.

FIELD OF THE INVENTION

The present invention relates generally to recreational watercraft devices and, more particularly, to water walking or riding apparatus for traveling along the surface of water in a cross-skiing type fashion.

BACKGROUND OF THE INVENTION

Moving across the surface of waters such as lakes, rivers and streams, bays and even oceans in or on human powered watercraft is a popular recreational activity. Various types of watercraft are available to pursue this activity and may include canoe and kayak types of watercraft which allow the user to sit within the watercraft while more recent sit on top type of watercraft have the user sitting on a deck of the watercraft. Propulsion through the water is achieved by manual user operation of a single- or double-bladed paddle. Such types of watercraft are generally single-hulled and are fairly stable in rough water.

Newer types of kayaks are designed for the user to stand upright while paddling around the water similar to the operator of a classic Venetian gondola. These standup kayaks are substantially less stable in rougher or swifter waters. Further, many of these canoe and kayak type of watercraft are generally slow through the water and difficult or physically challenging and exhausting to use. Additionally, when a user is thrown or falls off or out of these types of watercraft, it is often difficult for the user to reenter the watercraft while in deep water. This may require the user to return to the shore or shallower waters to reenter or reboard the watercraft.

Some types of watercraft are available which allow a user to essentially walk on the water surface, i.e. to move the legs in a sort of walking movement while riding on the watercraft. However, these known watercrafts suffer from the same instability and difficulty of reentry that the known types of canoes and kayaks suffer from.

Accordingly, there continues to be a need for a quick and stable standup type of water watercraft that is easy to operate. There is also a need for a standup type of watercraft that is easy to reboard and physically less stressful to operate.

SUMMARY OF THE INVENTION

The present invention is directed to a water riding apparatus for moving through the surface of water in cross-country skier fashion. The water riding apparatus includes a first pontoon having an elongate hull and a second pontoon having an elongate hull. The first and second elongate hulls are connected together for relative parallel longitudinal motion by a gliding mechanism affixed to inner sides of the first and second elongate hollow hulls. The first and second elongate hulls can include foot well openings allowing the user to stand on the bottoms of the hulls at a location below the water line of the hulls, and a personal stabilizer system for supporting a user in a standing position. The first and second elongate hulls can be locked in a parallel, transversely aligned relationship to allow alternative use of the water riding apparatus in a sitting, kayak-type fashion.

In a first implementation of the invention, a water riding apparatus for moving along the surface of water in cross-country skier type fashion comprises a first pontoon and a second pontoon, respectively including a first hull and a second hull, wherein both hulls are elongately formed along a front-to-back, longitudinal direction. The water riding apparatus further comprises a gliding mechanism positioned between the first and second hulls. The gliding mechanism including a first gliding mechanism portion affixed to the first hull and a second gliding mechanism portion movably mounted to the first gliding mechanism portion and affixed to the second hull. The second gliding mechanism portion is movable relative to the first gliding mechanism portion in the longitudinal direction such that the first and second hulls are connected together for reciprocal parallel motion.

In a second aspect, the first and second gliding mechanism portions can be affixed to respective inner sides of the first and second hulls oriented towards one another.

In another aspect, the first gliding mechanism portion can include an elongated C-shaped channel and the second gliding mechanism portion can include an H-shaped protrusion which slides within the C-shaped channel.

In another aspect, the first and second hulls can include a respective foot well terminated in a respective top foot well opening. The foot wells can be configured to receive a user's feet therein and to allow the feet to stand on bottoms of the first and second hulls at a position below a waterline of the first and second hulls.

In another aspect, the first and second pontoons can include a personal stabilizer system comprising a first pole extending upward from the first hull and a second pole extending upward from the second hull. The first and second poles can be configured to be gripped by a user standing on the pontoons.

In another aspect, the first and second poles can be height-adjustable relative to the first and second pontoons, respectively.

In another aspect, the personal stabilizer system can include first and second stabilizer arms mounted to the first and second hulls for support of the first and second poles.

In another aspect, the first and second stabilizer arms can be movably mounted to the first and second hulls.

In another aspect, the first and second poles can be rotatable relative to the first and second hulls, respectively, about respective horizontal transverse rotation axes which are perpendicular to the longitudinal direction.

In another aspect, the first and second pontoons can include first and second rudders.

In another aspect, the first and second pontoons can include first and second pivotable levers connected to the first and second rudders and configured to operate the first and second rudders for rotation.

In another aspect, the first and second pivotable levers can extend out of the first foot well opening and the second foot well opening, respectively.

In another aspect, the first and second pontoons can include first and second pivotable keels which are movable from a first stowed position alongside the first and second hulls to second deployed position extending below the first and second hulls.

In another aspect, the first and second pontoons can include at least one stabilizing fin, the stabilizing fin including hydro-directional teeth.

In another aspect, the water riding apparatus can further include at least one paddle removably affixed to the first pontoon or the second pontoon.

In another aspect, the water riding apparatus can further include a pair of removable side floats which are removably attachable to the first and second pontoons, respectively. The removable side floats can adopt a stabilizing position in which they are removably attached to a respective one of the first and second pontoons and extend transversely outward from the pontoons, with a bottom of the side floats arranged higher than a bottom of said respective one of the first and second pontoons.

In another aspect, each one of the first and second pontoons can include a respective set of one or more pivotable panels which are pivotable relative to a corresponding horizontal, transverse rotation axis perpendicular to the longitudinal direction.

In another aspect, the set of one or more pivotable panels of the first pontoon can be carried by a first elongated body which is removably attached to a bottom of the first hull, and the set of one or more pivotable panels of the second pontoon can be carried by a second elongated body which is removably attached to a bottom of the second hull.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a water riding apparatus for a user to travel across the surface of water in a standing position, while carrying out a cross-skiing like body movement. Optionally, the user can also sit down and operate one or more paddles to move along the water surface.

Figure 1:
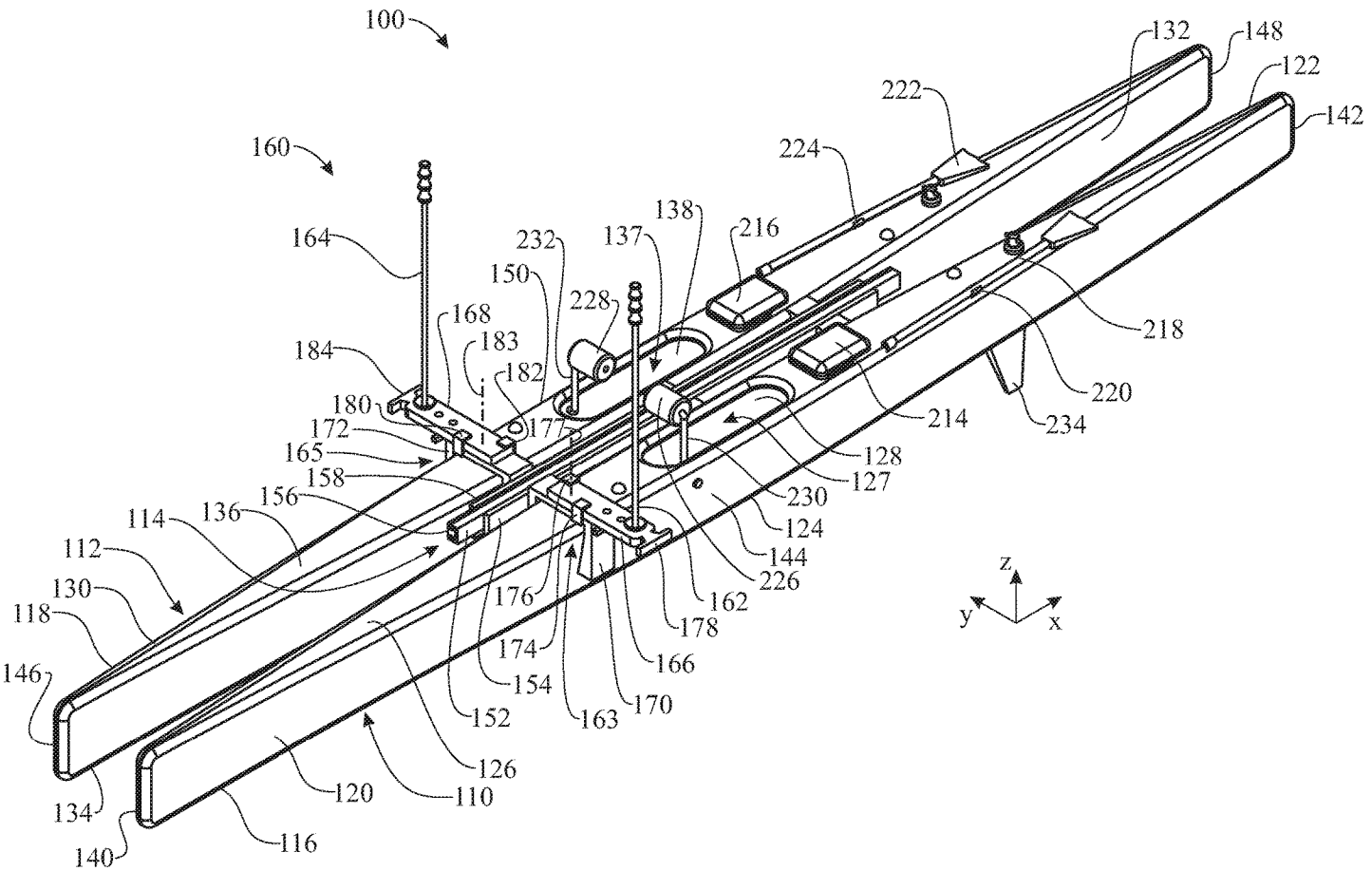
FIG. 1 presents a top front perspective view of a water riding apparatus in accordance with a first embodiment of the invention, shown in an at rest position.
Figure 2:
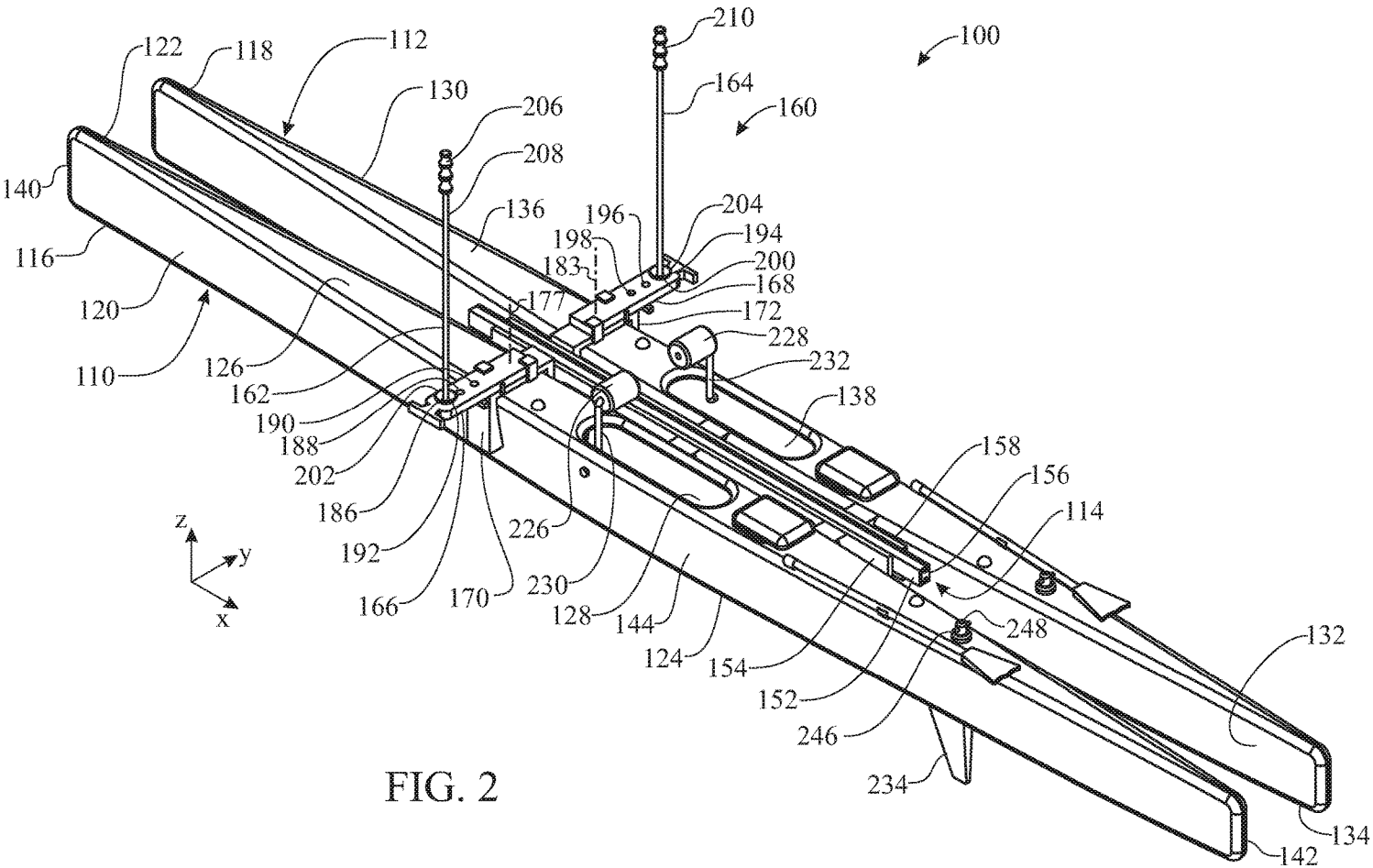
FIG. 2 presents a top rear perspective view of the water riding apparatus of FIG. 1.

Referring to FIGS. 1-7, and initially with regard to FIGS. 1 and 2, there is disclosed a water riding apparatus 100 in accordance with a first illustrative embodiment of the invention. The water riding apparatus 100 generally includes a first pontoon 110, a second pontoon 112 and a gliding mechanism 114 connecting the first and second pontoons 110, 112. The first and second pontoons 110, 112 of the present embodiment are elongated and formed along a longitudinal direction x. The gliding mechanism 114 allows the first and second pontoons 110, 112 to move longitudinally or translate relative to each other and enable a user to propel the water riding apparatus 100 through and across the surface of water in cross-country skier type fashion.

The first pontoon 110 includes an elongated, hollow first hull 116 and the second pontoon 112 includes an elongated, hollow second hull 118. The first and second hulls 116, 118 provide sufficient stability and flotation to support a user standing in an upright position on and in the first and second pontoons 110, 112. The first hull 116 includes a first or outer side 120, a second or inner side 122 and a bottom 124 extending across the outer and inner sides 120, 122, A top deck 126 also extends across the outer and inner sides 120, 122 and includes a foot well opening 128 providing access to a foot well 127 arranged within the first hull 116 for receipt of the foot and leg of a user. Likewise, the second hull 118 includes an outer side 130, an inner side 132 and a bottom 134 extending across the outer and inner sides 130, 132, A top deck 136 is also provided across the outer and inner sides 130, 132 and includes a foot well opening 138 providing access to a foot well 137 arranged within the second hull 118 for receipt of the other foot and leg of a user. Having the user place his or her feet inside foot wells 127, 137 allows the user to stand near the bottom 124, 134 of the hulls 116, 118, which is slightly below the water's surface, rather than standing on the top decks 126, 136, which ride slightly above the water's surface. By standing slightly below the water's surface, the stability of the user standing in the water riding apparatus 100 is significantly increased.

It should be noted that the first and second hulls 116, 118 are shaped to have a fine entry through the water to more easily advance and a similarly fine exit to reduce drag as the water riding apparatus 100 moves through the water. This reduces paddling effort and any concurrent fatigue for the user. Specifically, the first hull 116 includes a narrow front end 140, a narrow trailing end 142 and a wider middle section 144. Likewise, the second hull 118 includes a narrow front end 146, a narrow trailing end 148 and a wider middle section 150. This gives the first and second hulls 116, 118 a very low drag profile as they pass through water.

The first and second hulls 116, 118 may be formed from any of a variety of material typically used in water riding apparatus, such as for example, aluminum, polymer or polymer composites, fiberglass, natural materials such as various woods including cedar, pine, mahogany etc. Further, the first and second hulls 116, 118 can curve or taper relatively evenly in the spans from the respective narrow front ends 140, 146 to the wider middle sections 144,150 and back to the narrow trailing ends 142, 148. Alternatively, the spans between the ends and the middle sections may be convex similarly to a canoe shape, or slightly concave to mimic the shape of a kayak or battleship.

The gliding mechanism 114 is provided to maintain the first and second pontoons 110, 112 in a parallel orientation and allow the first and second pontoons 110, 112 to translate back and forth relative to each other to propel the water riding apparatus 100 through the water. The gliding mechanism 114, best shown in FIGS. 3 and 7, generally includes a longitudinally extending C-shaped channel 152 affixed to the first hull 116 by a first longitudinal plate 154, and an H-shaped protrusion 156 affixed to the second hull 118 by a second longitudinal plate 158. The C-shaped channel 152 generally defines a hollow, longitudinal retaining channel 250 for sliding receipt of the H-shaped protrusion 156. The C-shaped channel 152 and first longitudinal plate 154 thereby form a first gliding mechanism portion affixed to the first pontoon 110, and the H-shaped protrusion 156 and second longitudinal plate 158 thereby form a second gliding mechanism portion affixed to the second pontoon 112. By means of the slidable engagement of the C-shaped channel 152 and the H-shaped protrusion 156, the first and second gliding mechanisms are slidable relative to one another to allow the first and second hulls 116, 118 to move parallel to each other, in a manner described in more detail hereinbelow.

As shown in FIG. 1, in order to assist a user in standing up and maintaining their balance in the water riding apparatus 100, the water riding apparatus 100 includes a personal stabilizer system 160 including a first stabilizer pole 162 and a second stabilizer pole 164 for grasping by a user. The personal stabilizer system 160 is positioned forward of the first and second foot wells 127, 137. The first stabilizer pole 162 and the second stabilizer pole 164 are coupled to a first pole-supporting structure 163 and a second pole-supporting structure 165, respectively. The first pole-supporting structure 163 is attached to the first pontoon 110 and includes a first stabilizer arm 166 which protrudes outwardly from the first pontoon 110, and a first stabilizer support bracket 170 that is affixed to the first hull 116 and to which the first stabilizer arm 166 is connected. Similarly, the second pole-supporting structure 165 is attached to the second pontoon 112 and includes a second stabilizer arm 168 which protrudes outwardly from the second pontoon 112, and a second stabilizer support bracket 172 that is affixed to the second hull 118 and to which the second stabilizer arm 168 is connected. The support brackets 170, 172 are generally U-shaped and are affixed over the first and second hulls 116, 118, respectively, and may be configured to conform to the sides of the hulls 116, 118.

Figure 7:
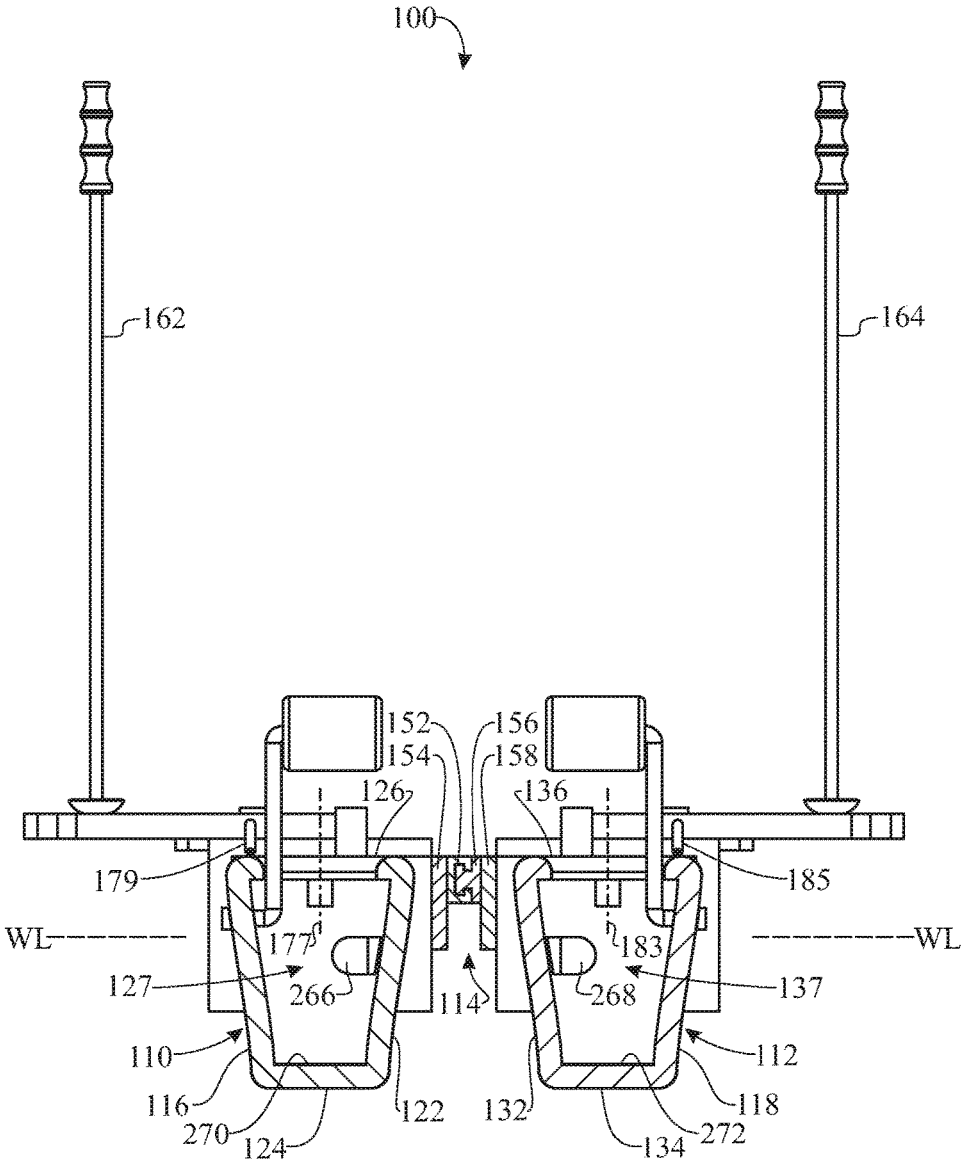
FIG. 7 presents a rear view, partially shown in cross-section, of the water riding apparatus of FIG. 1.

Specifically, with regard to FIG. 1, the first stabilizer arm 166 is affixed to the first support bracket 170 at an articulated connection (not shown) defining a first rotation axis 177. The first stabilizer arm 166 can rotate with respect to the first support bracket 170 about the first rotation axis 177. The first stabilizer arm 166 can rotatably adopt an outer, extended position as shown in FIG. 1, in which the first stabilizer arm 166 protrudes outwardly and generally perpendicularly from the first pontoon 110, In this extended position, the first stabilizer arm 166 is prevented from rotating forward (i.e. clockwise, if observed in top plan view) by hooks 174, 176 extending from the first support bracket 170; in turn; a first latch 179 can be arranged in a vertical locking position (as shown in FIG. 7) preventing the first stabilizer arm 166 from rotating rearward (i.e. counterclockwise, if observed in top plan view) from the extended position. The first latch 179 can be selectively rotated to a horizontal, unlocking position (from vertical locking position of FIG. 7) to free the first stabilizer arm 166 to rotate rearward (i.e. counterclockwise, if observed in top plan view) towards the first pontoon 110. Thus, the first stabilizer arm 166 is selectively movable from an outward position (FIG. 1) for use in supporting the first stabilizer pole 162, to an inward position for stowage. The first stabilizer arm 166 includes a T-shaped outward hook end 178 which allows a user to snag the water riding apparatus 100 with a pole should the user be dislodged from the water riding apparatus 100.

Figure 3:
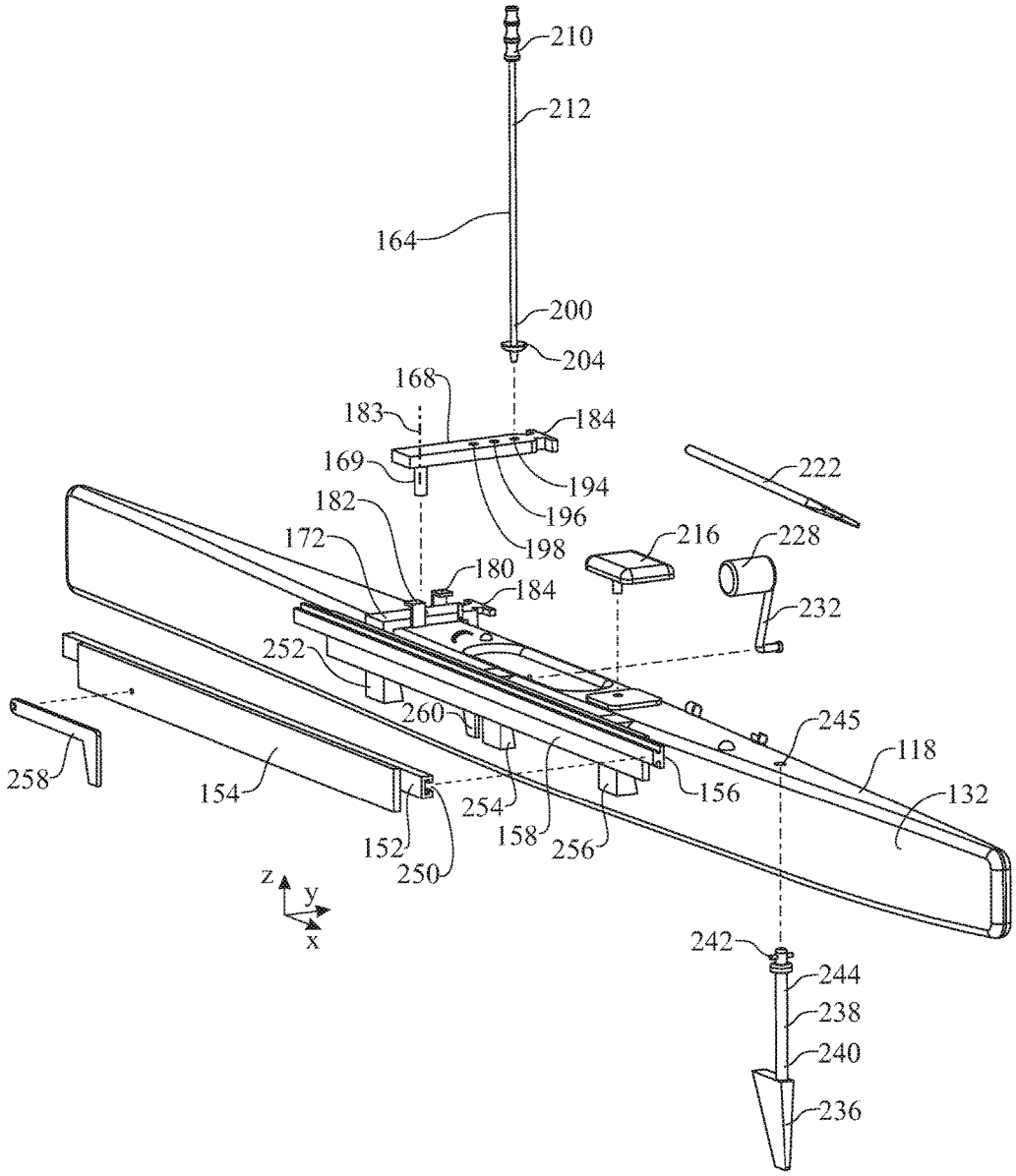
FIG. 3 presents a top rear perspective view, with some parts separated, of generally half of the water riding apparatus of FIG. 1.

Likewise, the second stabilizer arm 168 is affixed to the second support bracket 172 at an articulated connection defining a second rotation axis 183; as shown in FIG. 3, the articulated connection is formed by a protruding vertical shaft 169 of the second stabilizer arm 168 rotationally engaging with a shaft-receiving cavity 173 in the second support bracket 172 (it is noted that the corresponding articulated connection of the first support bracket 170, in turn, can be similarly constructed). The second stabilizer arm 168 can rotate with respect to the second support bracket 172 about the second rotation axis 183. The second stabilizer arm 168 can rotatably adopt an outer, extended position as shown in FIG. 1, in which the second stabilizer arm 168 protrudes outwardly and generally perpendicularly from the second pontoon 112. In this extended position, the second stabilizer arm 168 is prevented from rotating forward (i.e. counterclockwise, if observed in top plan view) by hooks 180, 182 extending from the second support bracket 172; in turn, a second latch 185 can be arranged in a vertical locking position (as shown in FIG. 7) preventing the second stabilizer arm 168 from rotating rearward (i.e. clockwise, if observed in top plan view) from the extended position. The second latch 185 can be selectively rotated to a horizontal, unlocking position (from vertical locking position of FIG. 7) to free the second stabilizer arm 168 to rotate rearward (i.e. clockwise, if observed in top plan view) towards the second pontoon 112. Thus, the second stabilizer arm 168 is selectively movable from an outward position (FIG. 1) for use in supporting the second stabilizer pole 164, to an inward position for stowage. The second stabilizer arm 168 includes a T-shaped outward hook end 184 to assist in snagging the water riding apparatus 100 by a user.

With regard to FIGS. 2 and 3, holes 186, 188, 190 are provided in the first stabilizer arm 166 to receive a bottom end 192 of the first stabilizer pole 162. Likewise, holes 194, 196, 198 are provided in the second stabilizer arm 168 for receipt of a bottom end 200 the second stabilizer pole 164. The multiple holes allow the user to selectively space the first and second stabilizer poles 162, 164 in a desired, comfortable position along a transverse direction y along a transverse direction y which is perpendicular to the longitudinal direction x. Circular flanges 202 (FIG. 2) and 204 (FIG. 4) are provided at respective bottom ends 192, 200 of the first and second stabilizer poles 162, 164 to limit insertion of the poles into the respective holes. A hand grip 206 is provided at a top end 208 of the first stabilizer pole 162 (FIG. and a hand grip 210 is provided at a top end 212 of the second stabilizer pole 164 (FIG. 3).

As shown in FIG. 3, the second longitudinal plate 158 is affixed to the second hull 118 by a leg 252 of the second stabilizer support bracket 172 and by additional mounts 254, 256 positioned between the second hull 118 and the second longitudinal plate 158. This allows the flat shape of the second longitudinal plate 158 to be attached to the angled or curved inner side 132 of the second hull 118 and yet be positioned in the longitudinal direction x. The first longitudinal plate 154 is similarly mounted to the inner side 122 of the first hull 116 by a leg (not shown) of the first stabilizer support bracket 170 and additional mounts.

Figure 4:
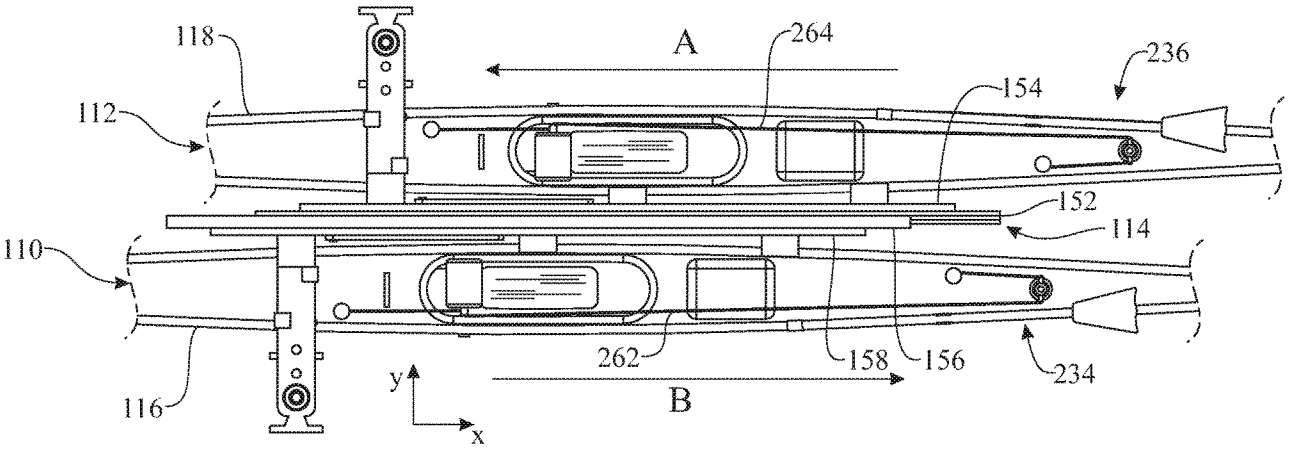
FIG. 4 presents a top plan view of the water riding apparatus of FIG. 1 in a first initial glide stroke.
Figure 5:
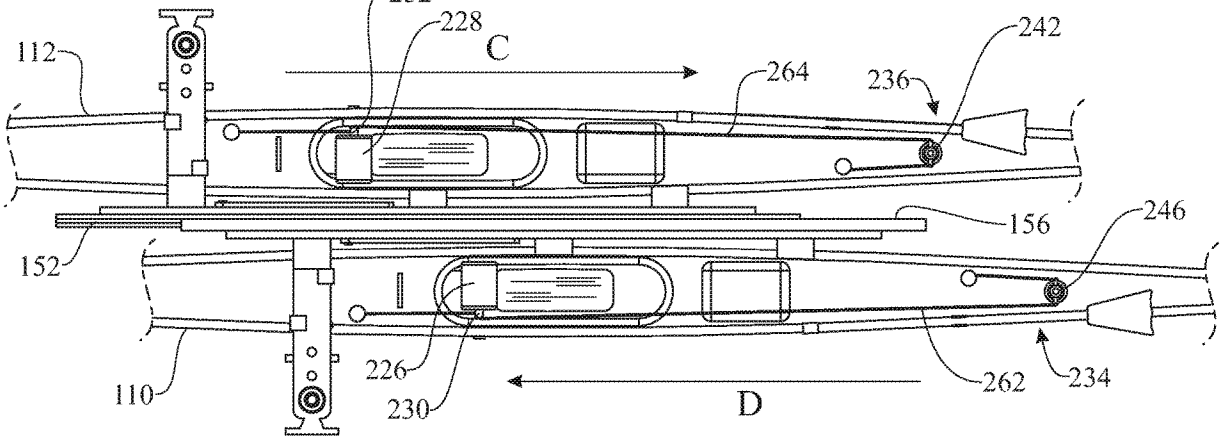
FIG. 5 presents a top plan view, similar to FIG. 4, of the water riding apparatus in a second glide stroke.

As best shown in FIGS. 4 and 5, in use, the water riding apparatus 100 is propelled by advancing one pontoon ahead of the other in the longitudinal direction x and repeating the motion in reciprocal fashion by operating the first and second pontoons 110, 112 in cross-skier like fashion. For example, in FIG. 4, in a first half of the skiing motion, the second pontoon 112 is advanced, relative to the first pontoon 110, in the forward longitudinal direction indicated by arrow A to move the second pontoon 112 forward through the water. The H-shaped protrusion 156 on the second pontoon 112 slides forward within the C-shaped channel 152 on the first pontoon 110. The first pontoon 110 moves rearward in the longitudinal direction as indicated by arrow B relative to the second pontoon 112, but remains stationary relative to the water or continues to glide forward if forward motion has already begun. It should be noted that the gliding mechanism 114 keeps or "locks" the first and second pontoons 110, 112 into parallel relationship.

In the second half of the skiing type motion, shown in FIG. 5, the first pontoon 110 is advanced in the longitudinal direction as indicated by arrow C and the second pontoon 112 moves relatively rearward in the longitudinal direction as indicated by arrow D while still gliding forward through the water. The C-shaped channel 152 on the first pontoon 110 is advanced relative to the H-shaped protrusion 156 on the second pontoon 112.

In order to facilitate turning when gliding through water, the water riding apparatus 100 comprises a first rudder 234 on the first hull 116 (FIGS. 1 and 2) and a second rudder 236 on the second hull 118 (FIG. 3), As shown in FIG. 3, the second rudder 236 is mounted on a shaft 238 at a bottom 240 of the shaft 238 and a pulley wheel 242 is mounted to a top end 244 of the shaft 238. The shaft 238 is rotatably mounted through a bore 245 in the second hull 118. While not specifically shown, the first rudder 234 is also mounted to the bottom end of a shaft extending through a bore in the first hull 116 and the shaft has a similar pulley wheel 246 mounted to a top end 248 (FIG. 2) of the shaft.

To allow a user to operate the rudders 234, 236, the water riding apparatus 100 further includes first and second pivotable levers 230, 232 movably mounted to the first and second hulls 116, 118, respectively. Corresponding leg cushions 226, 228 are attached to the first and second pivotable levers 230, 232 at top ends thereof, in a preferably rotatable manner or roller-type arrangement. The first and second pivotable levers 230, 232 extend upward and the leg cushions 226, 228 extend out of the first and second foot wells 127, 137. As shown in FIGS. 4 and 5, cables 262, 264 are connected from the pivotable levers 230, 232 to the respective first and second rudders 234, 236, allowing the first pivotable lever 230 to control the first rudder 234 and the second pivotable lever 232 to control the second rudder 236. The first cable 262 is affixed to the first pivotable lever 230 and is wrapped around the first pulley wheel 246. The second cable 264 is affixed to the second pivotable lever 232 and is wrapped around the second pulley wheel 242.

Figure 6:
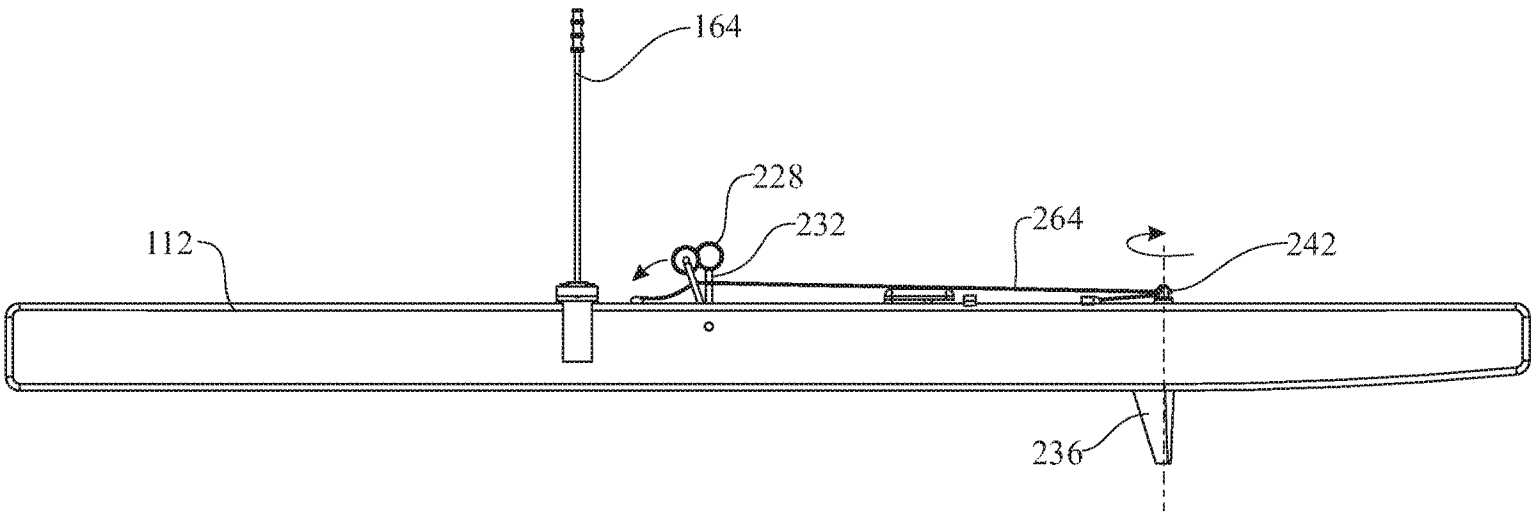
FIG. 6 presents a side elevation view of the water riding apparatus of FIG. 1, illustrating a steering mechanism.

By pushing the leg cushion 226, 228 of the corresponding first and second pivotable lever 230, 232 with the user's corresponding shin, a user standing with his or her feet in the first and second foot wells 127, 137 can operate the first or second rudder 234, 236 and thus cause the water riding apparatus 100 to turn in water. For example, the illustration of FIG. 6 shows the second rudder 236 being actuated by pressing a knee against the second leg cushion 228 to move the pivotable lever 232 forward. By moving the second pivotable lever 232, the cable 264 pulls on the second pulley wheel 242 and rotates the second pulley wheel 242 and the second rudder 236.

When using the water riding apparatus 100 in a standing position, the user can make a slow turn by advancing the pontoon on the side of the direction of the turn and then "leans into" the turn as the user would do while cross-country skiing. Should a sharper turn be desired, the first and second rudders 234, 236 may be actuated by pressing the user's knee or leg against the appropriate respective leg cushion 226 or 228 to thereby actuate the correct pivotable lever 230 or 232. In this manner, the user can more sharply and quickly change the direction of the water riding apparatus 100. It should be noted that this turning mechanism can be used both in the sitting and standing positions.

With reference for the moment to FIG. 7, and as noted above, the stabilizer poles 162, 164 are available to help stabilize the user while standing in the water riding apparatus 100. The water riding apparatus 100 is substantially more stable than other stand on type kayaks because the user stands on the bottoms 124, 134, which are below the waterline WL of the first and second hulls 116, 118, rather than on the top decks 126, 136 which are above the waterline WL. For further stability, an inner non-slip surface 270, 272 may be provided on the bottoms 124, 134 to prevent the user's feet from slipping.

Figure 8:
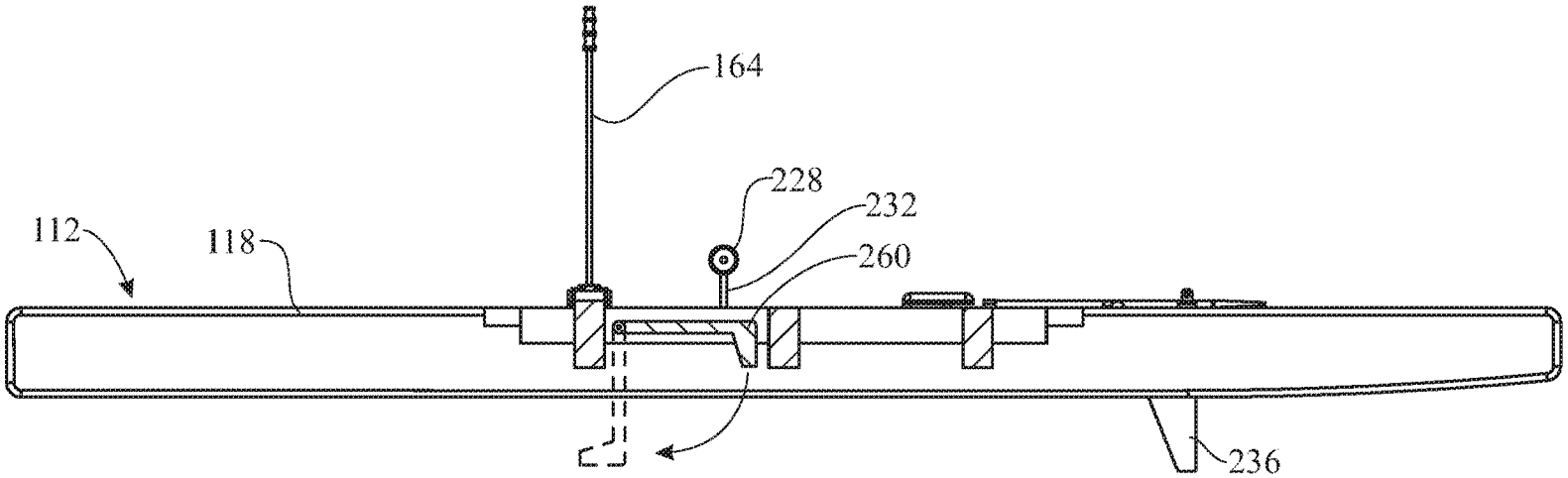
FIG. 8 presents a cross-sectional view, taken along the line 8-8 of FIG. 7, illustrating a foldable guide keel.

In order to further stabilize the first and second hulls 116, 118 and maintain a straighter track through the water, the first and second hulls 116, 118 can be provided with foldable guiding elements or pivotable keels 258, 260, respectively. The pivotable keels 258, 260, shown in FIGS. 3 and 8, can be movably mounted to the first and second longitudinal plates 154, 158 and can be positioned between the first and second hulls 116, 118. The pivotable keels 258, 260 shown herein are movable between a first raised or stowed position alongside the respective first and second hulls 116 (FIG. 3) to a second lowered or deployed position extending below the first and second hulls 116, 118 (FIG. 8). When deployed down into the water, the pivotable keels 258, 260 may assist the water riding apparatus 100 to track straight through the water. When in the raised positions, the water riding apparatus 100 can be turned more easily.

Figure 9:
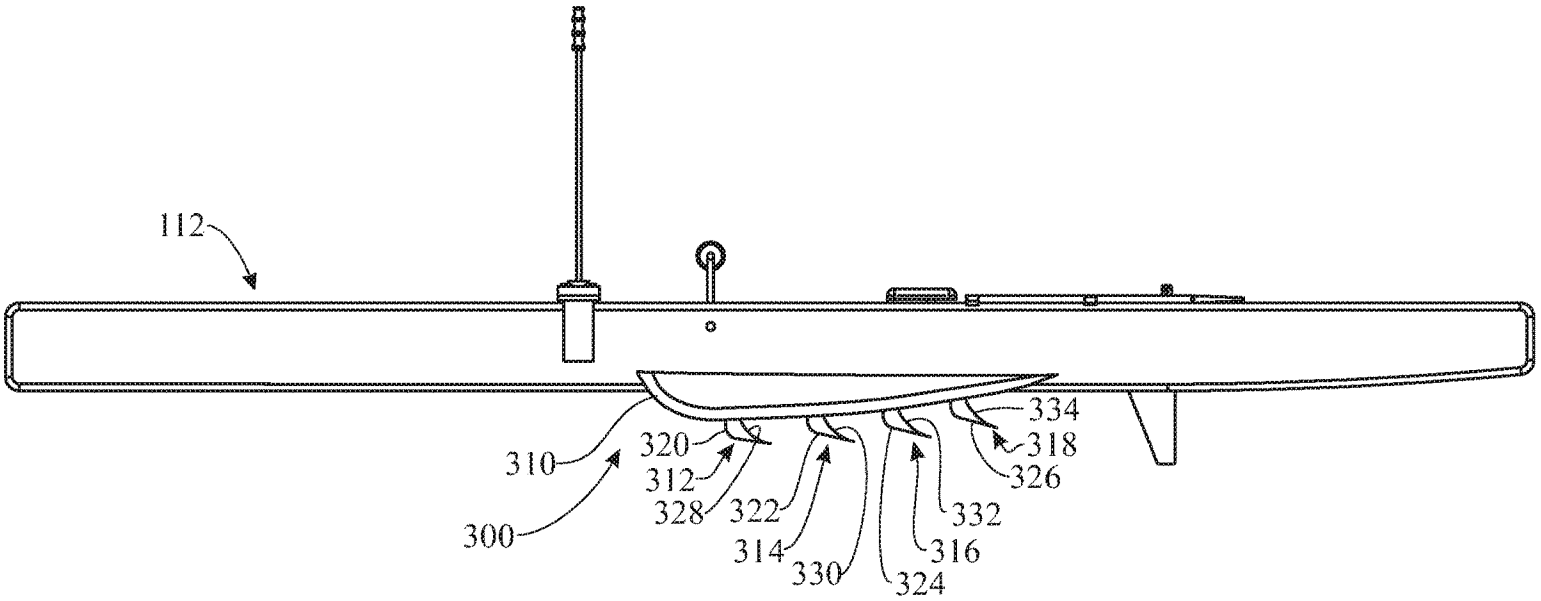
FIG. 9 presents a side elevation view of a second embodiment of a water riding apparatus of the present invention, the water riding apparatus having a stabilizing fin.

Turning to FIG. 9 there is illustrated an alternative and/or optional stabilizing fin 300 for use with the first and/or second pontoons 110, 112. The stabilizing fin 300 includes a base 310 affixed to an underside of a pontoon, for example to the bottom 134 of the second pontoon 112. A plurality of hydro-dynamically directional teeth 312, 314, 316 and 318 extend downwardly from the base 310 in saw tooth fashion. The teeth 312-318 are configured with leading edges 320, 322, 324 and 326 that slice easily through the water and have trailing edges 328, 330, 332 and 334 that resist and grab or push against the water as the second pontoon 112 is propelled forward.

Alternatively to the standing, cross-skiing type position described heretofore, a user may choose to use the water riding apparatus 100 of the present disclosure in a sitting position, similarly to a conventional sit-on-top kayak. The water riding apparatus 100 of the present disclosure can be switched from a standing configuration to a sitting configuration by carrying out minimal adjustments. On one hand, the water riding apparatus 100 can include a locking mechanism which locks the first gliding mechanism portion and the second gliding mechanism portion of the gliding mechanism 114 to one another, preventing them from sliding, and thus locking the first and second pontoons 110, 112 in a parallel, aligned configuration as shown in FIG. 1. For instance, the locking mechanism can comprise removably insertable vertical lock pins extending through the C-shaped channel 152 and the H-shaped protrusion 156. The water riding apparatus 100 depicted herein also includes first and second seat pads 214, 216 for the user to comfortably sit on. The first and second seat pads 214, 216 can be non-movably affixed to the first and second pontoons 110, 112. In alternative embodiments, the first and second seat pads 214, 216 can be elongated in shape, and rotationally attached to the first and second pontoons 110, 112, respectively, so that a user can rotate the first and second seat pads 214, 216 away from one another to adopt a generally parallel, spaced-apart configuration as shown in FIG. 1 (for using the water riding apparatus 100 in a standing position), or alternatively rotate the first sat pad 214 ninety degrees counterclockwise and the second seat pad 216 ninety degrees clockwise to form transversely aligned, joint seat pad on which to sit. In addition, as shown in FIG. 1, a removable first paddle 218 is retained on the top deck 126 of the first hull 116 by a retaining clip 220 and a removable second paddle 222 is retained on the top deck 136 by a retaining clip 224. Further, as shown in FIG. 7, side protuberances 266, 268 extend inwardly from the inner sides 122, 132 of the first and second hulls 116, 118 and into the first and second foot wells 127, 137 and provide an elevated foot rest (with respect to the bottoms 124, 134) for the user when the water riding apparatus 100 is used in the sitting position.

In this manner, the disclosed water riding apparatus 100 provides a stable platform for a user to move across the water in standing, cross-skier like fashion or in a sitting, kayaking fashion.

Figure 10:
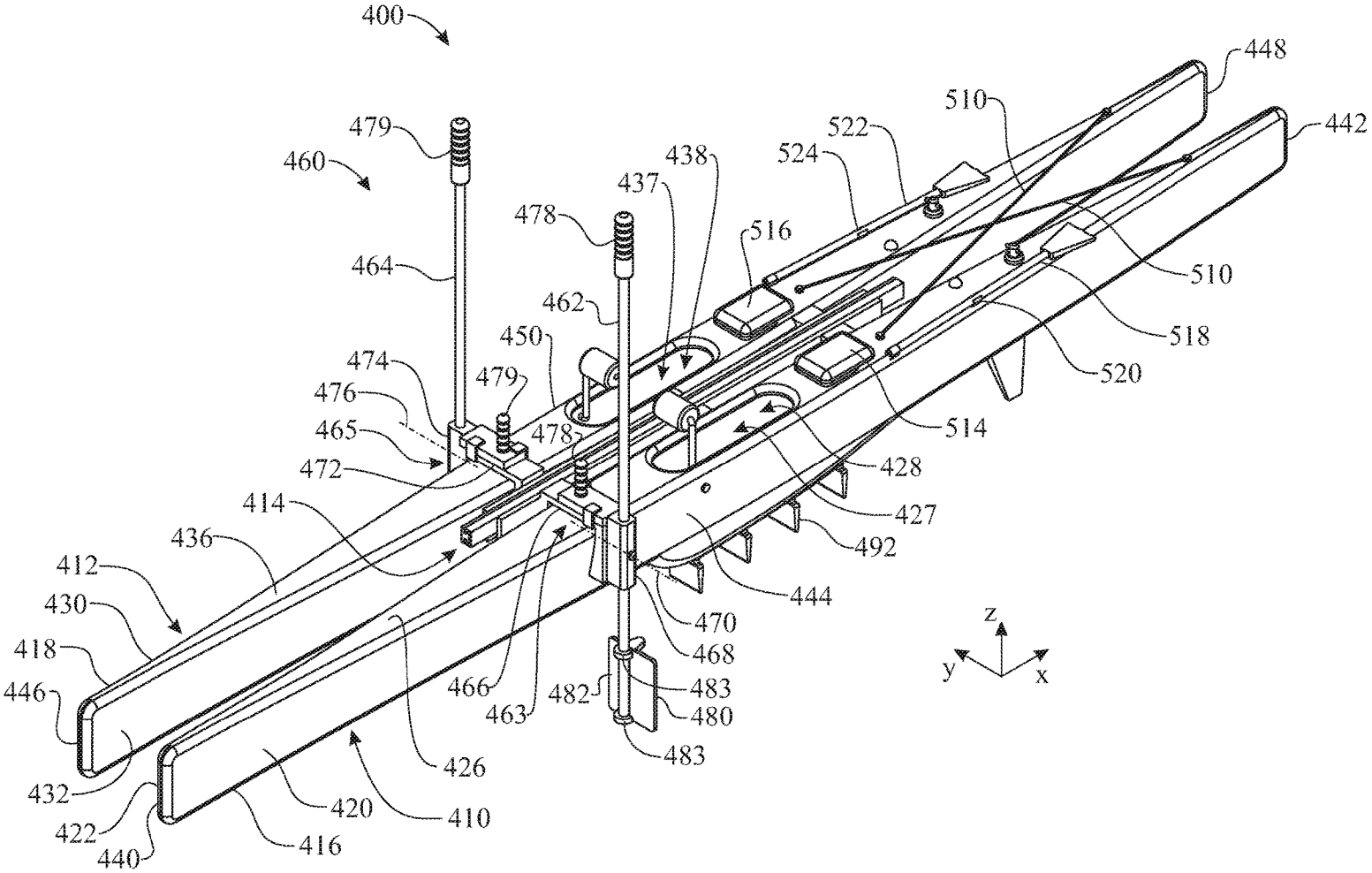
FIG. 10 presents a top front perspective view of a water riding apparatus in accordance with a third embodiment of the invention, shown in an at rest position.
Figure 11:
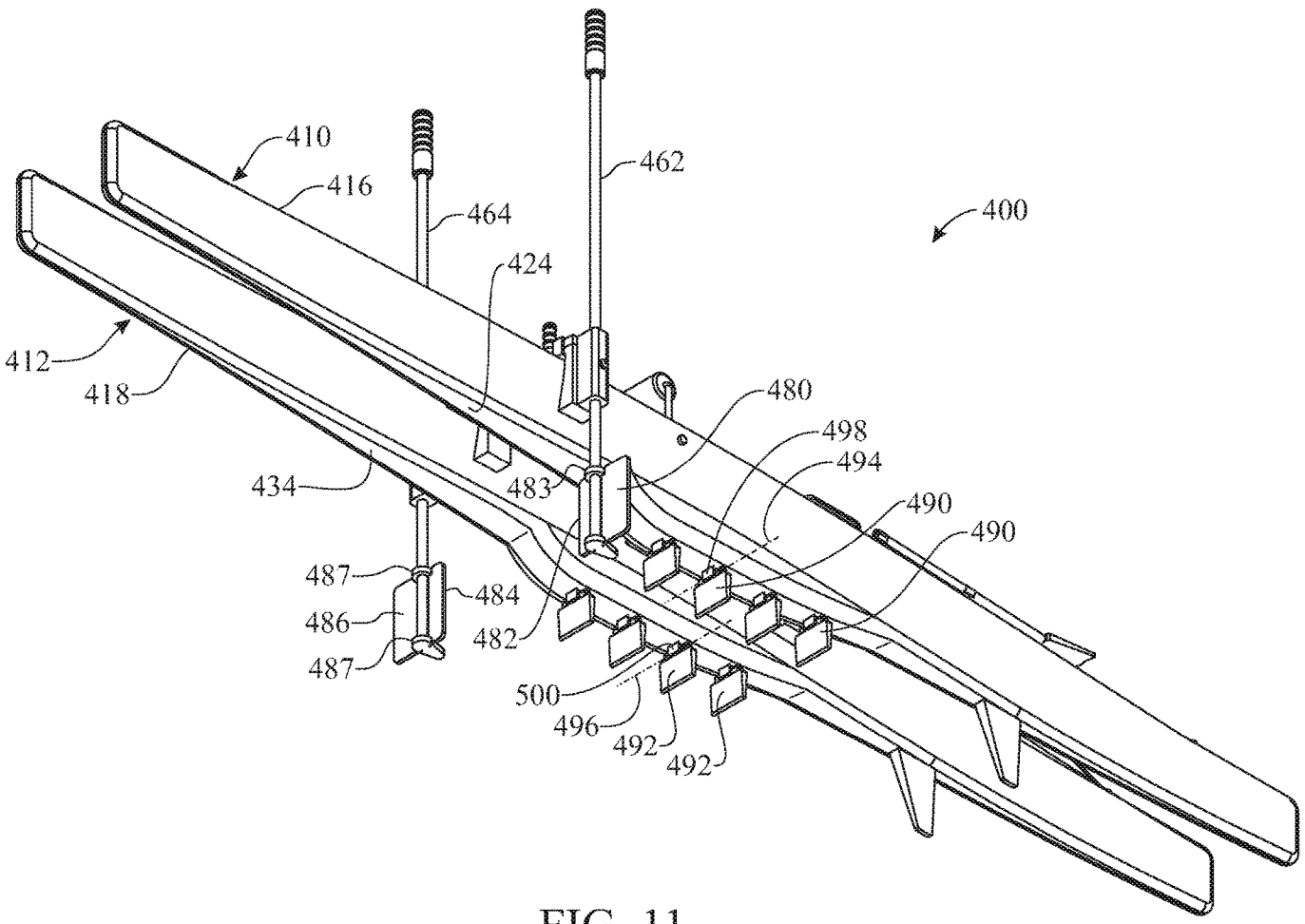
FIG. 11 presents a bottom front perspective view of the water riding apparatus of FIG. 10.

Referring to FIGS. 10-14, and initially with regard to FIGS. 10 and 11, there is disclosed a water riding apparatus 400 in accordance with a third illustrative embodiment of the invention.

Similarly to the water riding apparatus 100 of FIG. 1, the water riding apparatus 400 generally includes a first pontoon 410 and a second pontoon 412. A gliding mechanism 414 similar to that of water riding apparatus 100 connects the first and second pontoons 410, 412 and allows the first and second pontoons 410, 412 to move longitudinally or translate relative to each other and enable a user to propel the water riding apparatus 400 through and across the surface of water similarly to the water riding apparatus 100 of FIG. 1. The first and second pontoons 410, 412 include elongated, hollow first and second hulls 416, 418 providing stability and flotation to support a standing or sitting user. The first hull 416 includes a first or outer side 420, a second or inner side 422, and a bottom 424 and top deck 426 extending across the outer and inner sides 420, 422. Likewise, the second hull 418 includes an outer side 430, an inner side 432, and a bottom 434 and a top deck 436 extending across the outer and inner sides 430, 432. Foot well openings 428, 438 are formed on the top decks 426, 436 providing access to respective foot wells 427, 437 arranged within the first and second hulls 416, 418 for receipt of the feet and legs of a user, allowing the user to stand near the bottom 424, 434 of the hulls 416, 418. The first and second hulls 416, 418 are shaped to have a fine entry through the water to more easily advance and a similarly fine exit to reduce drag as the water riding apparatus 400 moves through the water. This reduces paddling effort and any concurrent fatigue for the user. Specifically, the first hull 416 includes a narrow front end 440, a narrow trailing end 442 and a wider middle section 444. Likewise, the second hull 418 includes a narrow front end 446, a narrow trailing end 448 and a wider middle section 450.

As shown in FIG. 10, in order to assist a user in standing up and maintaining their balance in the water riding apparatus 400, the water riding apparatus 400 includes a personal stabilizer system 460 including a first stabilizer pole 462 and a second stabilizer pole 464 for grasping by a user. The personal stabilizer system 460 is positioned forward of the first and second foot wells 427, 437. The first stabilizer pole 462 and the second stabilizer pole 464 are coupled to a first pole-supporting structure 463 and a second pole-supporting structure 465, respectively. The first pole-supporting structure 463 is attached to the first pontoon 410 and includes a fixed portion 466 affixed to the first hull 416 and a pivotable portion 468 pivotably affixed to the fixed portion 466 about a generally horizontal and transverse rotation axis 470. The first stabilizer pole 462 is coupled to the pivotable portion 468 (for instance, inserted through the pivotable portion 468) and is pivotable about the rotation axis 470 jointly with the pivotable portion 468. Similarly, the second pole-supporting structure 465 is attached to the second pontoon 412 and includes a fixed portion 472 affixed to the second hull 418 and a pivotable portion 474 pivotably affixed to the fixed portion 472 about a generally horizontal and transverse rotation axis 472 which is parallel to rotation axis 470. The second stabilizer pole 464 is coupled to the pivotable portion 474 (for instance, inserted through the pivotable portion 474) and is pivotable about the rotation axis 476 jointly with the pivotable portion 474. The first and second stabilizer poles 462, 464 can pivot or sway forward and rearward independently from one another about the respective rotation axes 470, 476. The fixed portions 466, 472 are generally U-shaped and are affixed over the first and second hulls 416, 418, respectively, and may be configured to conform to the sides of the hulls 416, 418. Further, the water riding apparatus 400 of the present embodiment includes first and second seat pads 514, 516 for the user to comfortably sit on. The first and second seat pads 514, 516 can be constructed and operate in the same ways as described with reference to the first end second seat pads 214, 216 of the water riding apparatus 100 of FIG. 1. In addition, a removable first paddle 518 is retained on the top deck 426 of the first hull 416 by a retaining clip 520 and a removable second paddle 522 is retained on the top deck 436 by a retaining clip 524.

Figure 13:
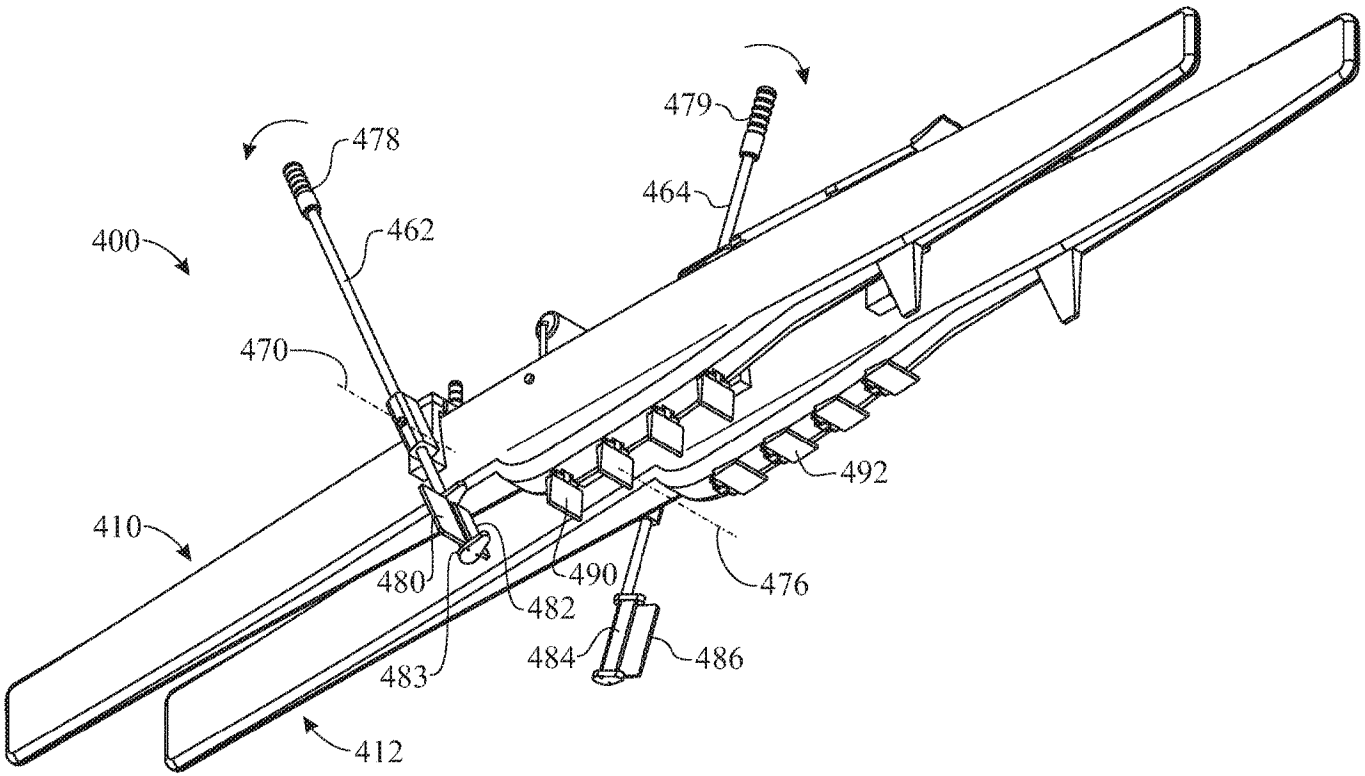
FIG. 13 presents a bottom rear perspective view of the water riding apparatus of FIG. 10; the stabilizer poles shown in a first position.
Figure 14:
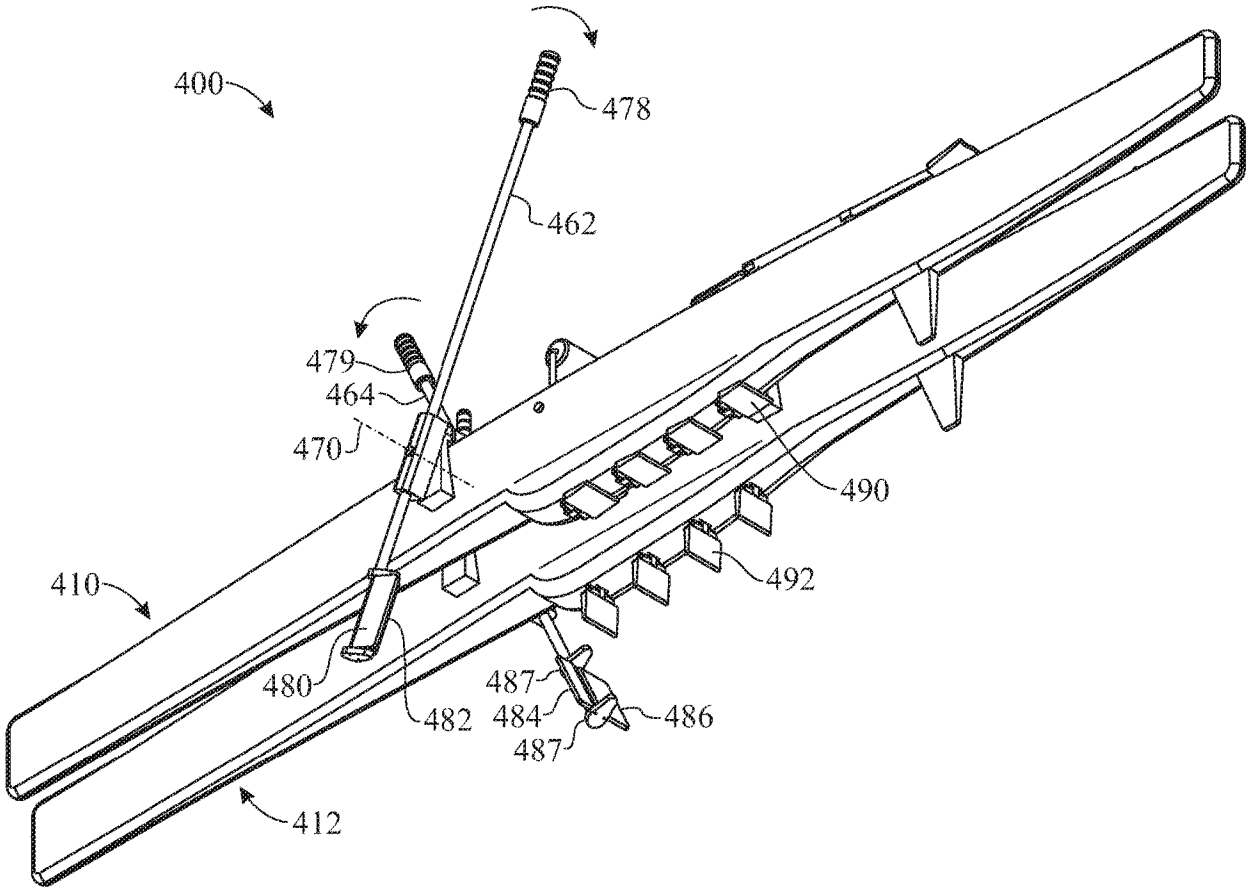
FIG. 14 presents a bottom rear perspective view of the water riding apparatus of FIG. 10; the stabilizer poles shown in a second position.

The water riding apparatus 400 of the present embodiment can be operated generally the same as the water riding apparatus 100 of the first embodiment. In other words, the user can adopt a standing position (preferably by standing with their feet inside the foot wells 427, 437) and carry out a back-and-forth stepping motion similar to a cross-skiing motion, thus moving the first and second pontoons 410, 412 in an alternative back-and-forth movement. While carrying out this cross-skiing-type leg movement, the user can grasp the first and second stabilizer poles 462, 464 and move their arms, and thus the first and second stabilizer poles 462, 464, back and forth for stability and to complete the cross-skiing-type movement as illustrated in FIGS. 13 and 14. In order to facilitate gripping of the first and second stabilizer poles 462, 464, a preferably non-slip hand grips 478, 479 can be provided at a top end of the first and second stabilizer poles 462, 464, respectively.

Alternatively, the user may sit down on the first and second seat pads 514, 516 and place their feet in the foot wells 427, 437; then, having locked the first and second pontoons 410, 412 so that they do not glide relative to one another, the user can utilize the first and second paddles 518, 522 to row and propel the water riding apparatus 400 along water.

As best shown in FIG. 11, in order to facilitate the forward propelling of the water riding apparatus 400 when riding the apparatus in a standing position, the first stabilizer pole 462 and the second stabilizer pole 464 of the present embodiment include a pair of articulated flaps 480, 482 and a pair of articulated flaps 484, 486, respectively. The articulated flaps 480, 482, 484, 486 are configured to be arranged inside the water when the water riding apparatus 400 is in operation, and are preferably arranged at a bottom end of the first and second stabilizer poles 462, 464. The articulated flaps 480, 482 of the first stabilizer pole 462 can pivot about a central longitudinal axis of the first stabilizer pole 462 towards and away from one another, so that the angle formed by the articulated flaps 480, 482 can vary. Similarly, the articulated flaps 484, 486 of the second stabilizer pole 464 can pivot about a central, longitudinal axis of the second stabilizer pole 464 towards and away from one another, so that the angle formed by the articulated flaps 484, 486 can vary. More specifically, the articulated flaps are configured to pivot towards one another when moving forward along water (i.e. when the user is pulling the corresponding stabilizer pole towards their body) and to pivot away from one another when moving rearward (i.e. when the user is pushing the corresponding stabilizer pole forward). One or more stops 483 are provided preventing the articulated flaps 480, 482 from pivoting frontward from a maximum advancement position, and preferably from a transverse, 180-degree arrangement of the articulated flaps 480, 482 as shown in FIG. 11. Similarly, one or more stops 487 prevent the articulated flaps 484, 486 from pivoting frontward from a maximum advancement position, and preferably from a transverse, 180-degree arrangement of the articulated flaps 484, 486 as also shown in FIG. 11.

The illustrations of FIGS. 13 and 14 show the articulated flaps 480, 482, 484, 486 in operation. With reference to the articulated flaps 480, 482 of the first stabilizer pole 462, it can be appreciated in FIG. 13 that when a top section of the first stabilizer pole 462 (i.e. the part of the first stabilizer pole 462 extending above the rotation axis 470) is being pushed forward by the user, the bottom section of the first stabilizer pole 462 (i.e. the part of the first stabilizer pole 462 extending below the rotation axis 470) pivots rearward, and the articulated flaps 480, 482 open up or pivot away from one another due to water resistance, and adopt the maximum advancement position (a transverse, 180-degree alignment) when stopped by the one or more stops 483. In turn, when a top section of the second stabilizer pole 464 (i.e. the part of the second stabilizer pole 464 extending above the rotation axis 476) is being pulled rearward by the user, the bottom section of the second stabilizer pole 464 (i.e. the part of the second first stabilizer pole 464 extending below the rotation axis 476) pivots frontward, and the articulated flaps 484, 486 pivot towards one another due to water resistance, and eventually and freely adopt a closed position as shown in FIG. 13. In this closed position, the articulated flaps 484, 486 freely align with the longitudinal direction of displacement of the first and second pontoons 410, 412, and thus the resistance offered by the articulated flaps 484, 486 against water is minimized. Thus, in the position of FIG. 13, the user can easily push the second pontoon 412 forward while the first pontoon 410 is retained from moving rearward by the articulated flaps 480, 482. The illustration of FIG. 14 shows an opposite situation in which the first stabilizer pole 462 is being pulled rearward and the second stabilizer pole 464 is being pushed frontward, and the position of the pairs of articulated flaps 480, 482; 484, 486 has been thus inverted.

Figure 12:
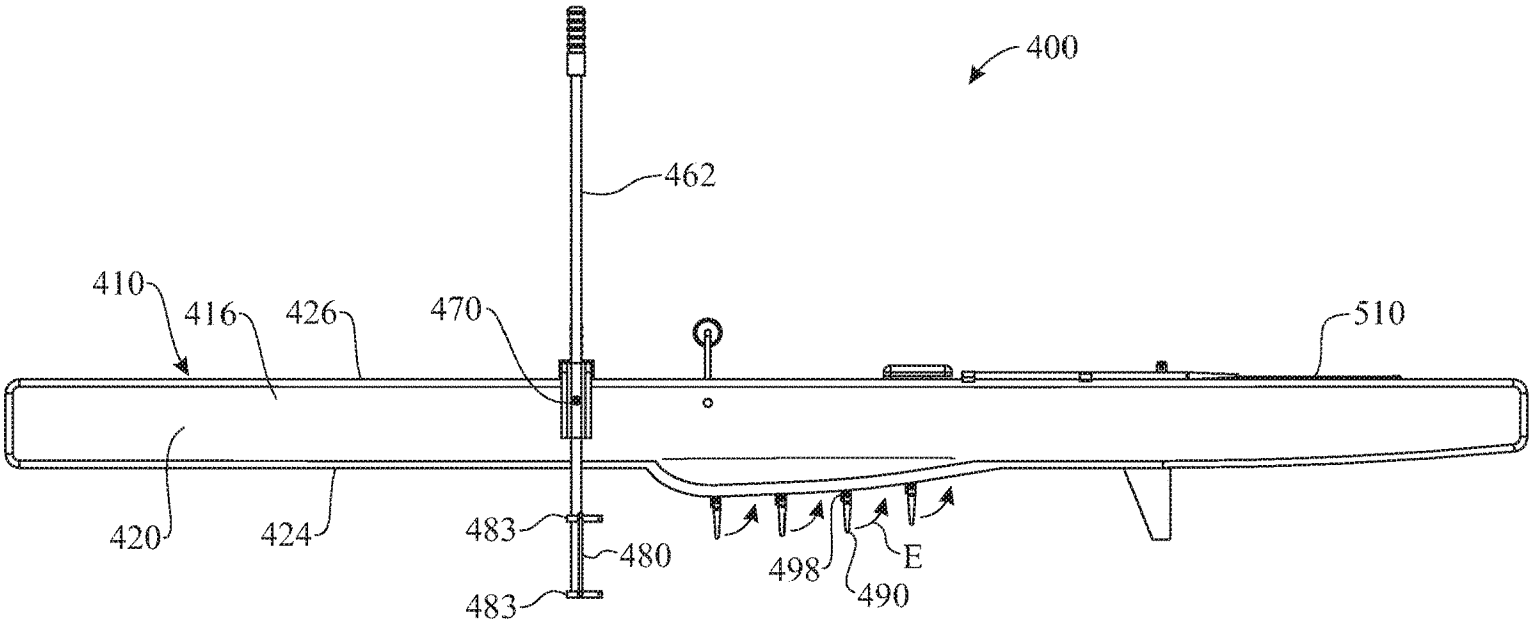
FIG. 12 presents aside elevation view of the water riding apparatus of FIG. 10.

In addition, the first pontoon 410 can include one or more pivotable panels 490 (e.g., four pivotable panels 490) which pivotably attached to the bottom 424 of the first hull 416. Similarly, the second pontoon 412 can include one or more pivotable panels 492 (e.g., four pivotable panels 492) pivotably attached to the bottom 434 of the second hull 418. Each pivotable panel 490, 492 is pivotably coupled to the corresponding first or second hull 416, 418 about a corresponding side-to-side, transverse rotation axis 494, 496 which is perpendicular to the longitudinal, front-to-back movement of the first and second pontoons 410, 412. In this way, the panels 490, 492 can pivot frontward and rearward. Furthermore, while the panels 490, 492 may freely pivot rearward, they are prevented from pivoting frontward of a maximum advancement position by a corresponding stop 498, 500. Preferably, the maximum advancement position is a vertical position as shown in FIG. 12; i.e., the stops 498, 500 prevent the panels 490, 492 from pivoting frontward from the vertical position, while allowing them to pivot rearward from the vertical position as indicated by arrows E. With reference again to FIGS. 13 and 14, it can be appreciated that the panels adopt a vertical position when the corresponding pontoon attempts to move rearward along the water, and a rearward folded position when the pontoon is moving frontward, in order to facilitate the forward movement of the water riding apparatus 400. For instance, the illustration of FIG. 13 shows the pivotable panels 490 of the first pontoon 410 in a vertical position in which they are stopped by the stops 498, and the pivotable panels 492 of the second pontoon 412 folded rearward against the second hull 418, minimizing their resistance against water; in consequence, the first pontoon 410 is retained from moving rearward and the second pontoon 412 can be more easily propelled forward.

The water riding apparatus 400 of the present embodiment further includes at least one elastic bungee cord 510 extending between the first and second pontoons 410, 412, which dampens the longitudinal front-to-back relative movement of the first and second pontoons 410, 412 relative to one another. In addition, the bungee cord or cords 510 bias the first and second pontoons 410, 412 to the aligned, rest position depicted in FIG. 10. Such biasing to the rest position assists the user in switching from a standing operation to a sitting operation of the water riding apparatus 400.

Figure 15:
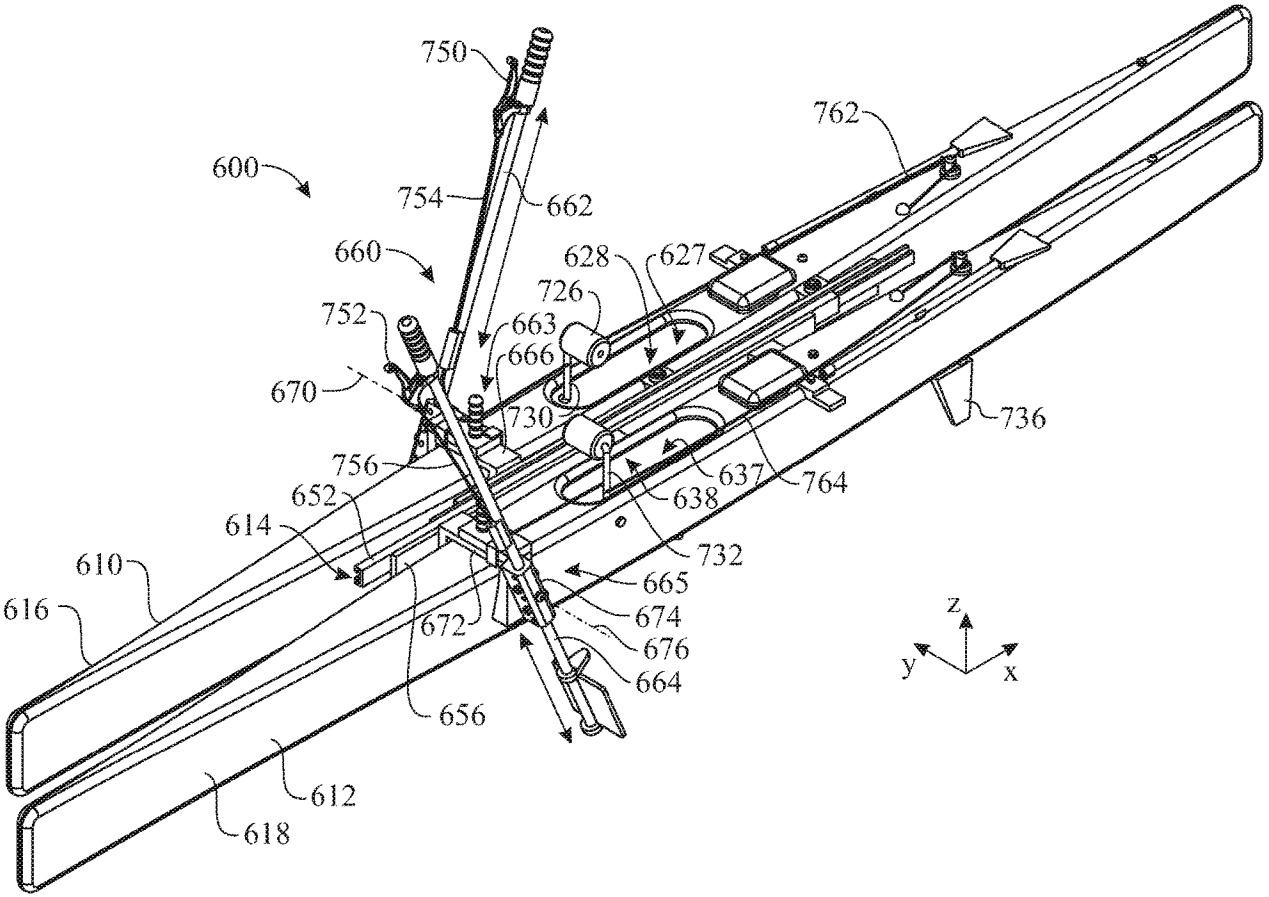
FIG. 15 presents a top front perspective view of a water riding apparatus in accordance with a fourth embodiment of the invention.
Figure 16:
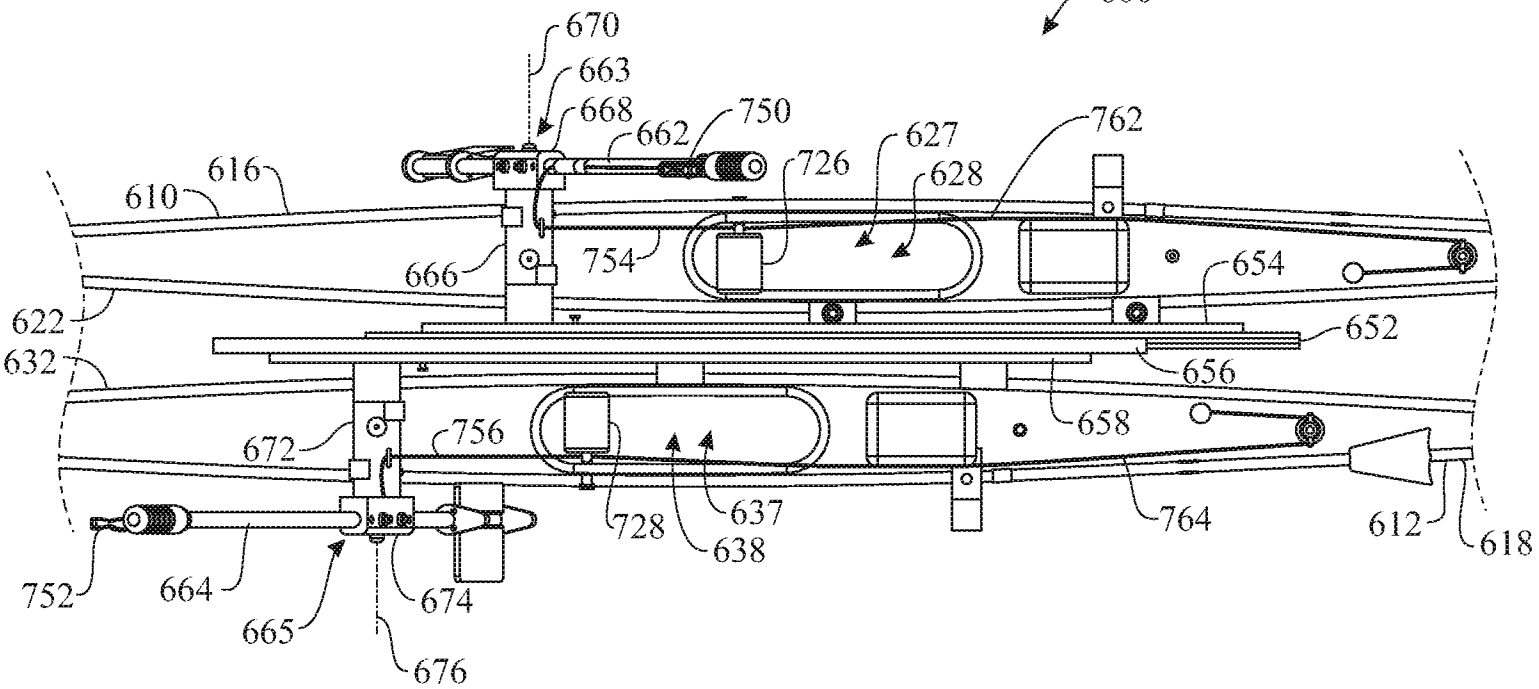
FIG. 16 presents a partial, top plan view of the water riding apparatus of FIG. 15.

Referring now to FIGS. 15-22, and initially to FIGS. 15 and 16, there is disclosed a water riding apparatus 600 in accordance with a fourth illustrative embodiment of the invention. The water riding apparatus 600 comprises a first pontoon 610 and a second pontoon 612, respectively including a first hull 616 and a second hull 618. Similarly to the previous embodiments, the first and second hulls 616, 618 are elongately formed along a front-to-back, longitudinal direction x. The water riding apparatus 600 further includes a gliding mechanism 614 positioned between the first and second hulls 616, 618. The gliding mechanism 614 includes a first gliding mechanism portion affixed to the first hull 616 and a second gliding mechanism portion affixed to the second hull 618. Similarly to the previous embodiments, the second gliding mechanism portion is movably mounted to the first gliding mechanism portion and is movable relative to the first gliding mechanism portion in the longitudinal direction x allowing the first and second hulls 616, 618 to be connected together for reciprocal parallel motion. Also similarly to the previous embodiments, the first gliding mechanism portion comprises a C-shaped channel 652 carried by a first longitudinal plate 654 which is in turn affixed to an inner side 622 of the first hull 616 of the first pontoon 610. The second gliding mechanism portion includes an H-shaped protrusion 656 carried by a second longitudinal plate 658 which is in turn affixed to an inner side 632 of the second hull 618 of the second pontoon 612. The H-shaped protrusion 656 is slidably received within the C-shaped channel 652.

Also similarly to the previous embodiments, the first and second hulls 616, 618 include a respective foot well 627, 637 terminated in a respective top foot well opening 628, 638. The foot wells 627, 637 provide a space for receiving a user's feet, so that the user can stand on bottoms 624, 634 of the first and second hulls 616, 618 at a position below the waterline of the first and second hulls 616, 618. In addition, the first and second pontoons 610, 612 include first and second pivotable levers 730, 732 connected to first and second rudders 734, 736, Cables 762, 764 are connected from the pivotable levers 730, 732 to the respective first and second rudders 734, 736, allowing the first pivotable lever 730 to control the first rudder 734 and the second pivotable lever 732 to control the second rudder 736. The first and second pivotable levers 730, 732 extend out of the first and second foot well openings 628, 638. Corresponding leg cushions 726, 728 are attached to the first and second pivotable levers 730, 732 at top ends thereof, allowing to comfortably operate the levers 730, 732 with the user's shins.

As the previous embodiments, the first and second pontoons 610, 612 include a personal stabilizer system 660 which allows a person to remain stable while standing on the bottoms 624, 634 within the foot wells 627, 637 and operating the apparatus. The personal stabilizer system 600 includes a first stabilizer pole 662 extending from the first hull 616 and a second stabilizer pole 664 extending from the second hull 618. As in the embodiment of FIGS. 10-14, the first stabilizer pole 662 and the second stabilizer pole 664 are coupled to a first pole-supporting structure 663 and a second pole-supporting structure 665, respectively. The first pole-supporting structure 663 is attached to the first pontoon 610 and includes a fixed portion 666 affixed to the first hull 616 and a pivotable portion 668 pivotably affixed to the fixed portion 666 about a rotation axis 670 which is arranged in the horizontal, transverse direction which is arranged in the horizontal, transverse direction y. Similarly to the embodiment of FIGS. 10-14, the first stabilizer pole 662 is inserted through the pivotable portion 668 and is pivotable about the rotation axis 670 jointly with the pivotable portion 668. Similarly, the second pole-supporting structure 665 is attached to the second pontoon 612 and includes a fixed portion 672 affixed to the second hull 618 and a pivotable portion 674 pivotably affixed to the fixed portion 672 about a rotation axis 672 which is arranged in the horizontal, transverse direction y. The second stabilizer pole 664 is inserted through the pivotable portion 674 and is pivotable about the rotation axis 676 jointly with the pivotable portion 674. Unlike said previous embodiment, however, the first and second stabilizer poles 662, 664 of the present embodiment are slidably received within the respective pivotable portion 668, 674 and can be vertically adjusted relative to the pivotable portion 668, 674, i.e. mounted and secured within the pivotable portion 668, 674 at different vertical positions relative to the pivotable portion 668, 674 in order to adjust the height of the first and second stabilizer poles 662, 664 in relation to the first and second pontoons 610, 612. The first and second stabilizer poles 662, 664 can pivot or sway forward and rearward independently from one another about the respective rotation axes 670, 676.

Figure 17:
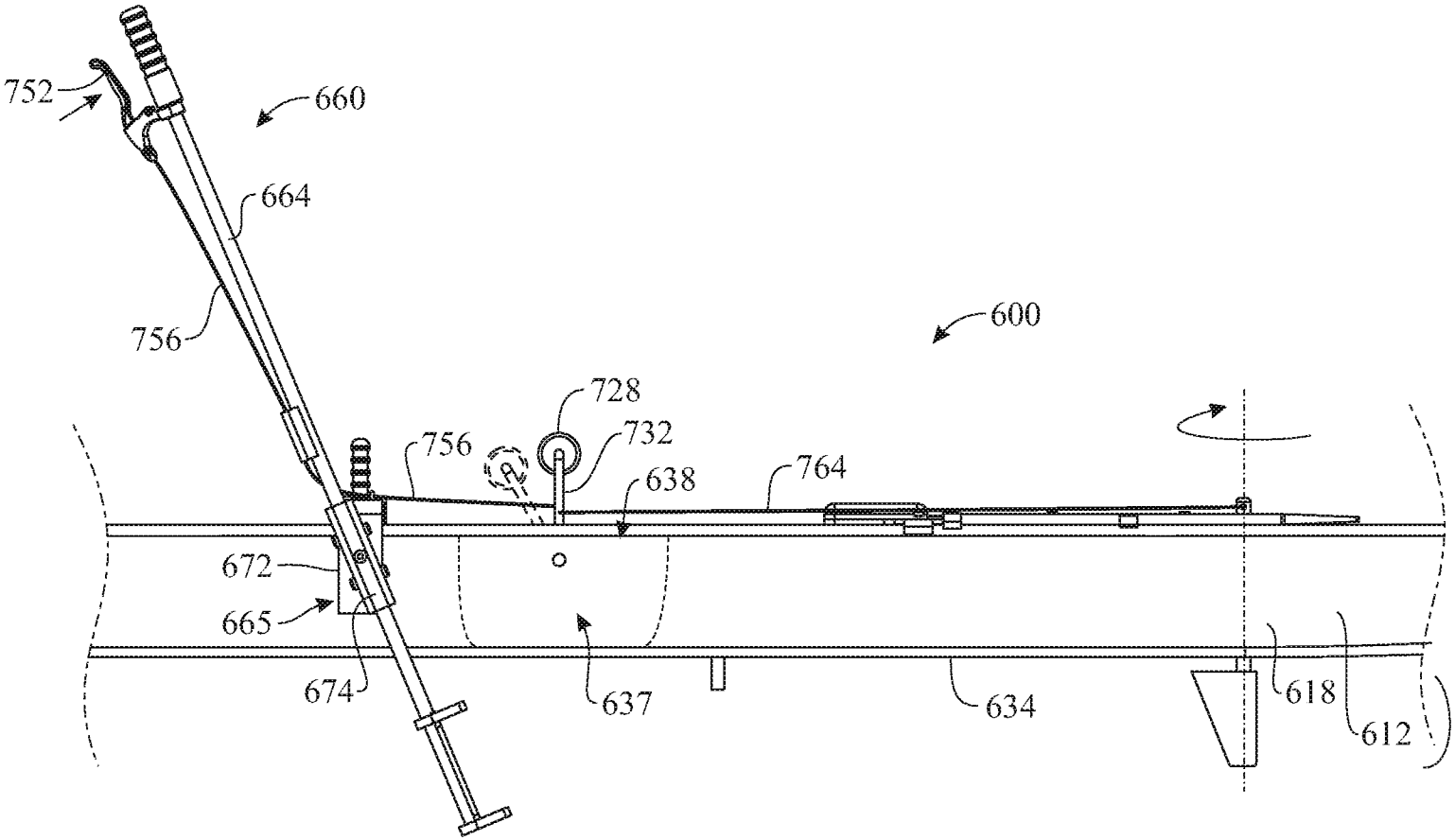
FIG. 17 presents a partial, side elevation view of the water riding apparatus of FIG. 15.

The water riding apparatus 600 of the present embodiment further includes a respective hand-operable control 750, 752 (e.g., a hand-operable lever, as shown) carried by each stabilizer pole 662, 664 at a top end thereof. A cable 754, 756 extends from each stabilizer pole 662, 664 to the corresponding pivotable lever 730, 732 on the same pontoon. As best shown in FIGS. 16 and 17, the hand-operable control 750, 752 is configured to pull or release the corresponding cable 754, 756 responsively to user operation of the hand-operable control 750, 752, selectively pulling or releasing the corresponding pivotable lever 730, 732 and causing the corresponding rudder 734, 736 to rotate. Thus, in the present embodiment, the user may operate the rudders 734, 736 with both the hands and shins.

Figure 18:
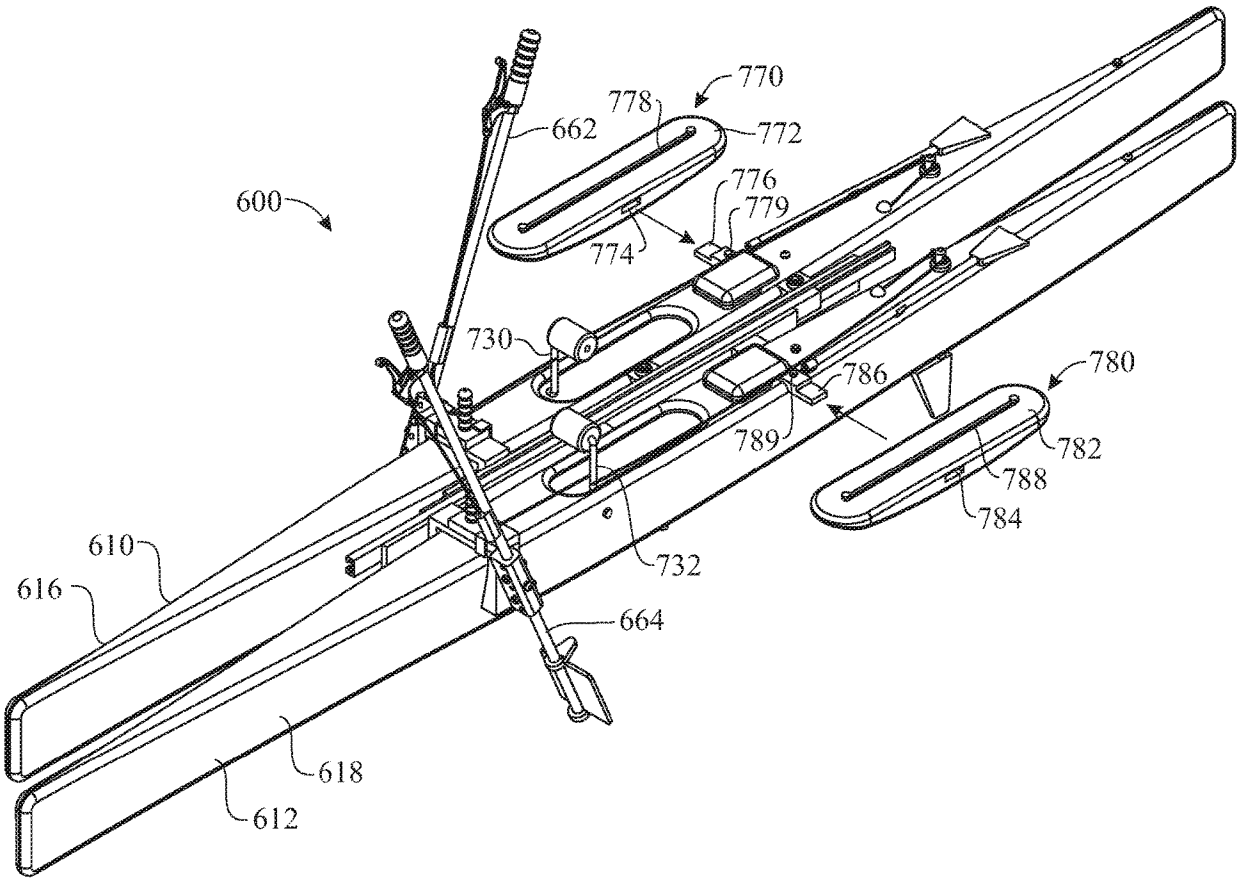
FIG. 18 presents a top front perspective view of the water riding apparatus of FIG. 15, showing respective removable side floats being attached to the pontoons.
Figure 19:
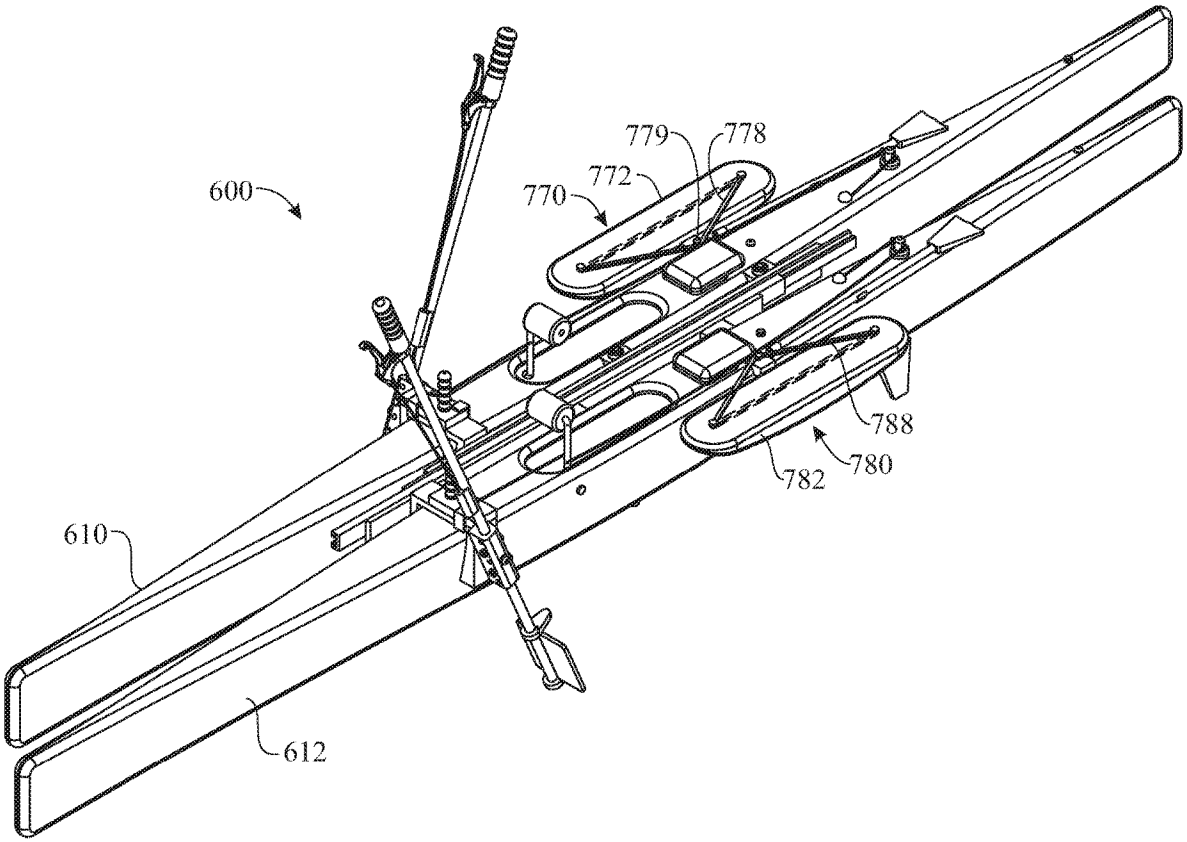
FIG. 19 presents a top front perspective view of the water riding apparatus of FIG. 15, showing the side floats attached to the pontoons.

As best shown in FIGS. 18 and 19, the water riding apparatus 600 can further include two auxiliary side floats 770, 780 which are disconnectedly attachable to the first and second pontoons 610, 612. More specifically, the first side float 770 includes a buoyant body 772 configured to float in water, the buoyant body 772 comprising a transversely extending cavity 774 facing the first pontoon 610 and removably fittable onto a transverse, mating protrusion 776 in the first pontoon 610. An elastically-stretchable cord or bungee 778 is affixed to the buoyant body 772 and configured to extend over and engage with a protrusion, hook or other bungee link 779 in the first pontoon 610. Similarly, the second side float 780 includes a buoyant body 782 configured to float in water, the buoyant body 782 comprising a transversely extending cavity 784 facing the second pontoon 612 and removably fittable onto a transverse, mating protrusion 786 in the second pontoon 612. An elastically-stretchable cord or bungee 788 is affixed to the buoyant body 782 and configured to extend over and engage with a protrusion, hook or other bungee link 789 in the second pontoon 612. The illustration of FIG. 19 shows the side floats 770, 780 removably attached to the first and second pontoons 610, 612 by having inserted the transverse protrusions 776, 786 into the cavities 774, 784 and extended the stretchable bungees 778, 788 over and onto the bungee links 779, 789, securing the bungees 778, 788 in a stretched position in which the bungees 778, 788 pull the side floats 770, 780 against the first and second pontoons 610, 612 and keep the side floats 770, 780 in place. In this assembled position of FIG. 19, the side floats 770, 780 extend transversely outward from the respective first and second pontoons 610, 612 and a bottom of the side floats 770, 780 is arranged above the bottoms 624, 634 of the first and second hulls 616, 618, and the side floats 770, 780 can float at or near water surface level while the bottoms 624, 634 of the first and second hulls 616, 618 are under water, the side floats 770, 780 thus providing an optional sideways stabilization of the apparatus which may be particularly useful for beginners.

Figure 20:
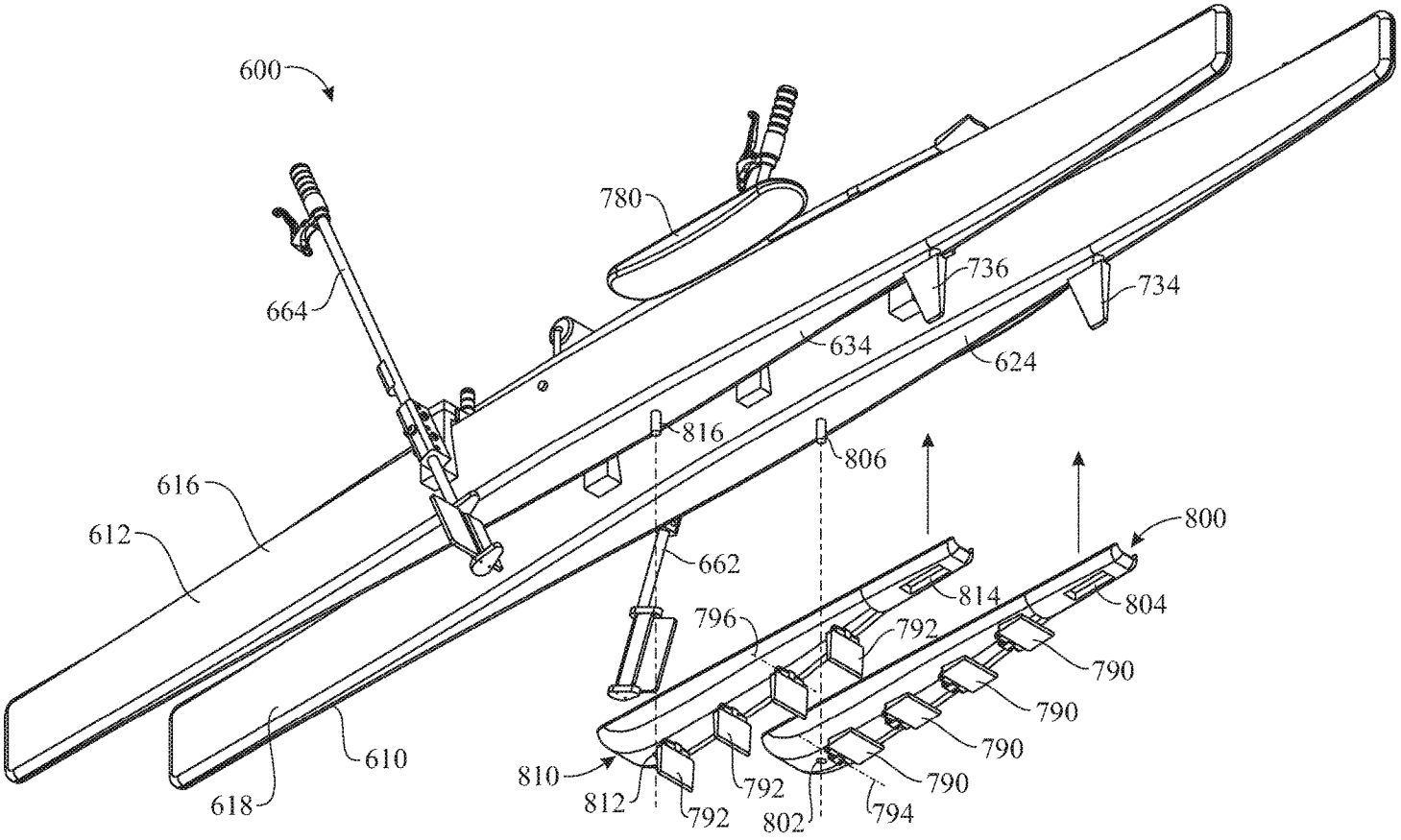
FIG. 20 presents a bottom rear perspective view of the water riding apparatus of FIG. 15, showing two removable, bottom elongated bodies carrying pivotable panels, the elongated bodies being attached to the pontoons.
Figure 21:
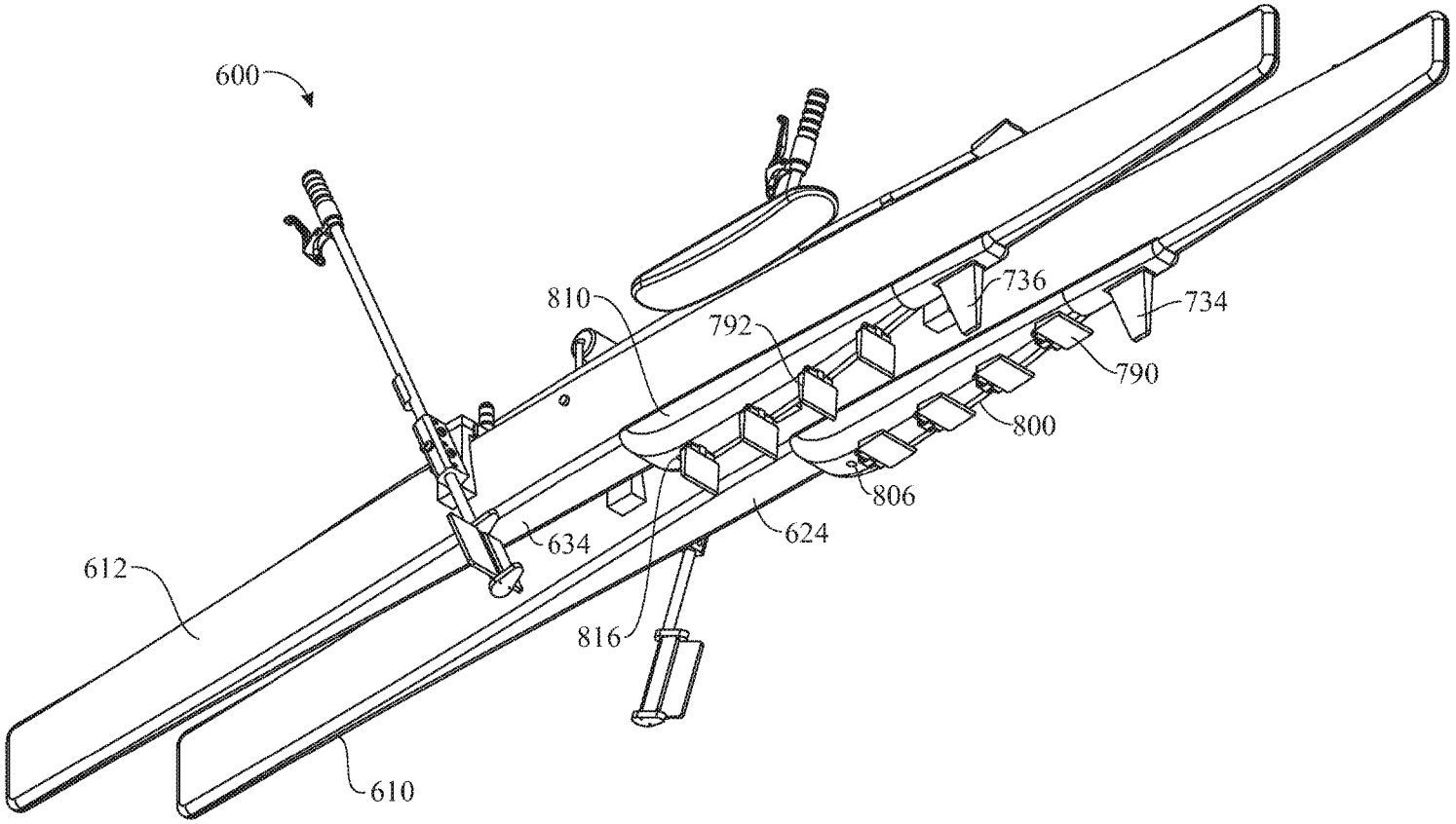
FIG. 21 presents a bottom rear perspective view of the water riding apparatus of FIG. 15, shoeing the two bottom elongated bodies attached to the pontoons.
Figure 22:
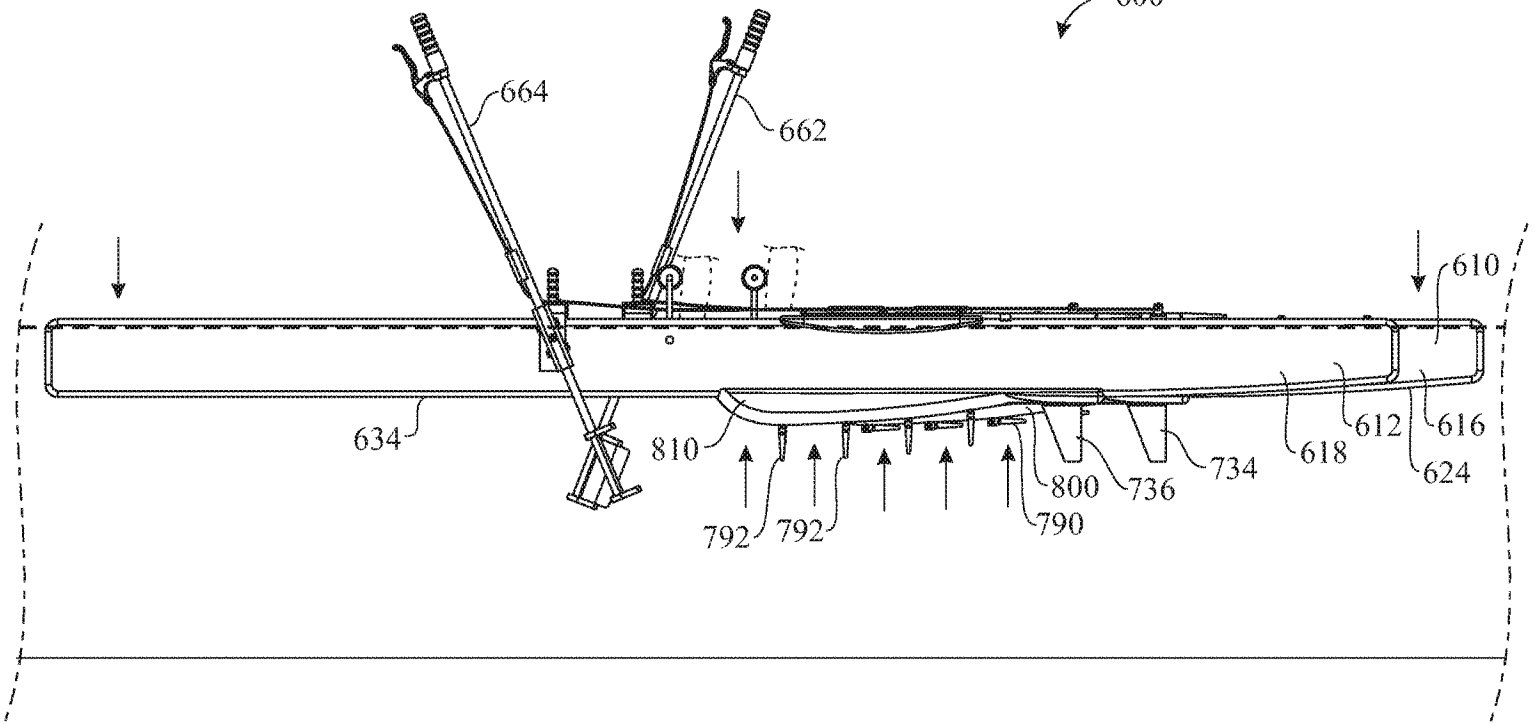
FIG. 22 presents a side elevation view of the water riding apparatus of FIG. 15, shown immersed in water, with the water pushing the elongated bodies towards the pontoons.

A further optional feature of the water riding apparatus 600 is shown in FIGS. 20-22. Similarly to the embodiment of FIGS. 10-14, the water riding apparatus 600 of the present embodiment is provided with bottom, pivotable panels to minimize rearward gliding and maximize forward gliding of the pontoons along water. Specifically, the first pontoon 610 comprises a first set of one or more pivotable panels 790 (e.g., four pivotable panels 790), where each pivotable panel 790 is pivotable relative to a corresponding horizontal, transverse rotation axis 794 perpendicular to the longitudinal direction x. Similarly, the second pontoon 612 comprises a second set of one or more pivotable panels 792 (e.g., four pivotable panels 792), where each pivotable panel 792 is pivotable relative to a corresponding horizontal, transverse rotation axis 796 perpendicular to the longitudinal direction x. Also similarly to the embodiment of FIGS. 10-14, while the panels 790, 792 may freely pivot rearward, they are prevented from pivoting frontward of a maximum advancement position by a corresponding stop (not numbered). In the present embodiment, however, the panels 790 of the first pontoon 610 are carried by a first elongated body 800 which is removably attached to the bottom 624 of the first hull 616. As shown, the first elongated body 800 can include a vertical hole 802 and a through slot 804, respectively configured to receive a vertically downward protrusion 806 of the first hull 616 and the first rudder 734. In turn, the panels 792 of the second pontoon 612 are carried by a second elongated body 810 which is removably attached to the bottom 634 of the second hull 618. The second elongated body 810 can include a vertical hole 812 and a through slot 814, respectively configured to receive a vertically downward protrusion 816 of the second hull 618 and the second rudder 736. The first and second elongated bodies 800, 810 are preferably made of foam and/or other highly buoyant material(s).

As shown in FIGS. 20 and 21, in order to assemble the first and second elongated bodies 800, 810 to the pontoons 610, 612, the first and second elongated bodies 800, 810 are fitted onto the bottom 624, 634 of the first and second hulls 616, 618 by inserting the vertically downward protrusions 806, 816 into the vertical holes 802, 812 and inserting the first and second rudders 734, 736 through the through slots 804, 814, and pushing the first and second elongated bodies 800, 810 as close as possible against the bottom 634, 636 of the first and second hulls 616, 618. As demonstrated in FIG. 22, when the water riding apparatus 600 is floating in water, the upward, the buoyant force exerted by water against the first and second elongated bodies 800, 810 maintains the first and second elongated bodies 800, 810 correctly positioned onto and against the bottom 634, 636 of the first and second hulls 616, 618. When inserted through the through slots 804, 814, the first and second rudders 734, 736 continue to be capable of rotating sideways. In the event that the user does not require the additional propelling effect provided by the pivotable panels 790, 792, he or she may remove the first and second elongated bodies 800, 810 from the pontoons 610, 612.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A water riding apparatus for moving along the surface of water in cross-country skier type fashion, comprising:

a first pontoon including a first hull elongately formed along a front-to-back, longitudinal direction;

a second pontoon including a second hull elongately formed along the longitudinal direction; and a gliding mechanism positioned between the first and second hulls, the gliding mechanism including a first gliding mechanism portion affixed to the first hull and a second gliding mechanism portion movably mounted to the first gliding mechanism portion and affixed to the second hull, the second gliding mechanism portion being movable relative to the first gliding mechanism portion in the longitudinal direction such that the first and second hulls are connected together for reciprocal parallel motion, wherein the first and second pontoons include first and second rudders, and the first and second pontoons include first and second pivotable levers connected to the first and second rudders and configured to operate the first and second rudders for rotation; wherein the first and second hulls include a respective foot well terminated in a respective top foot well opening, the foot wells configured to receive a user's feet therein and to allow said feet to stand on respective bottoms of the first and second hulls at a position below a waterline of the first and second hulls; and further wherein the first and second pivotable levers extend out of the first foot well opening and the second foot well opening, respectively.

2. The water riding apparatus of claim 1, wherein the first gliding mechanism portion is affixed to an inner side of the first hull and the second gliding mechanism portion is affixed to an inner side of the second hull, said inner sides oriented towards one another.

3. The water riding apparatus of claim 1, wherein the first gliding mechanism portion comprises an elongated C-shaped channel and the second gliding mechanism portion comprises an H-shaped protrusion which slides within the C-shaped channel.

4. The water riding apparatus of claim 1, wherein the first and second pontoons include a personal stabilizer system comprising a first pole extending upward from the first hull and a second pole extending upward from the second hull, the first and second poles configured to be gripped by a user standing on the pontoons.

5. The water riding apparatus of claim 4, wherein the first and second poles are height-adjustable relative to the first and second pontoons, respectively.

6. The water riding apparatus of claim 4, wherein the personal stabilizer system includes first and second stabilizer arms mounted to the first and second hulls for support of the first and second poles.

7. The water riding apparatus of claim 6, wherein the first and second stabilizer arms are movably mounted to the first and second hulls.

8. The water riding apparatus of claim 4, wherein the first and second poles are rotatable relative to the first and second hulls, respectively, about respective horizontal transverse rotation axes which are perpendicular to the longitudinal direction.

9. The water riding apparatus of claim 1, wherein the first and second pontoons include first and second pivotable keels, the first and second pivotable keels movable from a first stowed position alongside the first and second hulls to second deployed position extending below the first and second hulls.

10. The water riding apparatus of claim 1, wherein the first and second pontoons include at least one stabilizing fin, the stabilizing fin including hydro-directional teeth.

11. The water riding apparatus of claim 1, further comprising at least one paddle removably affixed to the first pontoon or the second pontoon.

12. The water riding apparatus of claim 1, further comprising a pair of removable side floats, wherein each removable side float of said pair is removably attachable to a respective one of said first and second pontoons, and further wherein each removable side float can adopt a stabilizing position in which said each side float is removably attached to said respective one of said first and second pontoons and extends transversely outward from said respective one of said first and second pontoons, with a bottom of said each side float arranged higher than a bottom of said respective one of said first and second pontoons.

13. The water riding apparatus of claim 1, wherein each one of the first and second pontoons comprises a respective set of one or more pivotable panels which are pivotable relative to a corresponding horizontal, transverse rotation axis perpendicular to the longitudinal direction.

14. The water riding apparatus of claim 13, wherein the set of one or more pivotable panels of the first pontoon is carried by a first elongated body which is removably attached to a bottom of the first hull, and the set of one or more pivotable panels of the second pontoon is carried by a second elongated body which is removably attached to a bottom of the second hull.

* * * * *